US010233041B2

(12) United States Patent
Okazaki et al.

(10) Patent No.: US 10,233,041 B2
(45) Date of Patent: Mar. 19, 2019

(54) SHEET SUPPORTING APPARATUS AND IMAGE FORMING APPARATUS

(71) Applicant: CANON KABUSHIKI KAISHA, Tokyo (JP)

(72) Inventors: Shunsuke Okazaki, Mishima (JP); Akira Matsushima, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/798,982

(22) Filed: Oct. 31, 2017

(65) Prior Publication Data

US 2018/0050878 A1 Feb. 22, 2018

Related U.S. Application Data

(62) Division of application No. 15/089,724, filed on Apr. 4, 2016, now Pat. No. 9,840,382.

(30) Foreign Application Priority Data

Apr. 13, 2015 (JP) ..... 2015-081577
May 20, 2015 (JP) ..... 2015-102863

(51) Int. Cl.
*B65H 1/14* (2006.01)
*B65H 1/26* (2006.01)
*G03G 15/00* (2006.01)

(52) U.S. Cl.
CPC ..... *B65H 1/14* (2013.01); *B65H 1/26* (2013.01); *G03G 15/6502* (2013.01);
(Continued)

(58) Field of Classification Search
CPC ..... B65H 1/14; B65H 1/00; B65H 2405/113; B65H 2405/00; B65H 2405/15; B65H 2511/10
See application file for complete search history.

(56) References Cited

U.S. PATENT DOCUMENTS 4,280,692 A 7/1981 Hutchinson et al.
5,419,544 A 5/1995 Ono et al.
(Continued)

FOREIGN PATENT DOCUMENTS

JP 2005170575 A 6/2005
JP 2011121723 A 6/2011
JP 2013155029 A 8/2013

OTHER PUBLICATIONS

Unpublished, copending U.S. Appl. No. 15/067,671 to Masatoshi Yoshida et al.

*Primary Examiner* — Patrick Cicchino
(74) *Attorney, Agent, or Firm* — Venable LLP

(57) ABSTRACT

A sheet supporting apparatus includes a body, a supporting portion configured to be held in an elevating manner by the body and to support a sheet, a sheet regulation portion regulating a position of the sheet supported on the supporting portion, a movement portion capable of moving between a first position where the sheet regulation portion regulates the position of the sheet supported on the supporting portion, and a second position where the supporting portion is regulated from elevating with respect to the body, and a movement regulation unit regulating the movement portion from moving to the second position.

15 Claims, 22 Drawing Sheets

(52) U.S. Cl.
CPC .... *B65H 2402/45* (2013.01); *B65H 2403/513* (2013.01); *B65H 2403/53* (2013.01); *B65H 2403/544* (2013.01); *B65H 2405/00* (2013.01); *B65H 2405/113* (2013.01); *B65H 2405/121* (2013.01); *B65H 2405/15* (2013.01); *B65H 2511/10* (2013.01); *B65H 2511/20* (2013.01); *B65H 2601/26* (2013.01); *B65H 2801/06* (2013.01)

(56) References Cited

U.S. PATENT DOCUMENTS

| | | | | |
|---|---|---|---|---|
| 5,713,570 | A * | 2/1998 | Ouchi | B65H 1/04 271/171 |
| 6,643,480 | B2 | 11/2003 | Kuwata et al. | |
| 6,830,245 | B2 | 12/2004 | Matsushima et al. | |
| 6,871,848 | B2 | 3/2005 | Matsushima et al. | |
| 7,448,613 | B2 | 11/2008 | Takahashi | |
| 7,862,031 | B2 | 1/2011 | Kaseda | |
| 7,971,868 | B2 | 7/2011 | Matsushima et al. | |
| 8,297,613 | B2 | 10/2012 | Katayama | |
| 8,302,956 | B2 | 11/2012 | Matsushima et al. | |
| 8,342,515 | B2 * | 1/2013 | Iwata | B65H 3/0607 271/171 |
| 8,448,938 | B2 | 5/2013 | Ko | |
| 8,469,356 | B2 | 6/2013 | Kweon | |
| 8,500,117 | B2 | 8/2013 | Uchida | |
| 8,556,253 | B2 | 10/2013 | Okazaki | |
| 8,657,511 | B2 | 2/2014 | Kim et al. | |
| 8,714,543 | B2 | 5/2014 | Matsushima et al. | |
| 8,746,682 | B2 | 6/2014 | Suleiman | |
| 8,783,677 | B2 | 7/2014 | Matsushima et al. | |
| 8,867,110 | B2 | 10/2014 | Chen | |
| 9,126,789 | B2 | 9/2015 | Hori et al. | |
| 9,256,183 | B2 | 2/2016 | Ohkubo et al. | |
| 9,701,495 | B2 * | 7/2017 | Ito | B65H 1/14 |
| 2011/0024970 | A1 | 2/2011 | Uchida et al. | |
| 2011/0140356 | A1 | 6/2011 | Katayama | |
| 2013/0194643 | A1 | 8/2013 | Chen | |

* cited by examiner

LETTER SIZE POSITION

A4 SIZE POSITION

LOCK POSITION

FIG.22

| | SWITCH 34a | SWITCH 34b |
|---|---|---|
| ( 1 ) | OFF | ON |
| ( 2 ) | ON | OFF |
| ( 3 ) | ON | ON |

SHEET SUPPORTING APPARATUS AND IMAGE FORMING APPARATUS

CROSS-REFERENCE TO RELATED APPLICATION

This application is a divisional of U.S. patent application Ser. No. 15/089,724, filed Apr. 4, 2016, which claims priority to Japanese Patent Application Nos. 2015-102863, filed May 20, 2015, and 2015-081577, filed Apr. 13, 2015, which are all herein incorporated by reference.

BACKGROUND OF THE INVENTION

Field of the Invention

The present invention relates to a sheet supporting apparatus supporting sheets and an image forming apparatus having the sheet supporting apparatus.

Description of the Related Art

Generally, in image forming apparatuses such as printers, copiers and facsimiles, a configuration is known where a sheet supporting base on which sheets are supported is disposed in an elevating manner using a wire. The sheet supporting base is designed to be elevated when feeding sheets, so that a feed roller is abutted against a sheet, and lowered when sheets should be supplied on the sheet supporting base. Since the sheet supporting base is disposed as described in an elevating manner within a sheet storage portion where sheets are stored, vibration or shock applied when the apparatus is being transported may cause the sheet supporting base to shake and collide against the sheet storage portion, and the sheet supporting base or the sheet storage portion may be damaged.

Hitherto, a sheet feeding device taught in Japanese Unexamined Patent Application Publication No. 2011-121723 has been proposed, where a packing material is mounted in a sheet storage portion and the packing material is adhered by tape to a sheet supporting base or surrounding materials, to thereby prevent damage of the sheet supporting base or the sheet storage portion that may occur during transportation. However, in such sheet feeding apparatus, if the adhesive force of the tape is weak, the tape may come off during transportation, and if the adhesive force is too strong, the tape may not be easily removed. Therefore, it was difficult to manage the adhesive force of the tape. Furthermore, if the sheet supporting base is fixed using tape or packing material, packing and unpacking required time, and was troublesome.

In contrast, Japanese Unexamined Patent Application Publication No. 2005-170575 proposes a paper feed cassette that locks a lift plate to a widthwise cursor, by moving the widthwise cursor positioning the paper sheets in the width direction toward the lift plate.

However, the widthwise cursor taught in Japanese Unexamined Patent Application Publication No. 2005-170575 is gripped and moved by a user, so that the user may erroneously fix the lift plate in an attempt to regulate the position of the sheets in the width direction using the widthwise cursor.

SUMMARY OF THE INVENTION

According to one aspect of the present invention, a sheet supporting apparatus includes a body, a supporting portion configured to be held in an elevating manner by the body and to support a sheet, a sheet regulation portion regulating a position of the sheet supported on the supporting portion, a movement portion capable of moving between a first position and a second position, the sheet regulation portion regulating the position of the sheet supported on the supporting portion in a case where the movement portion is positioned at the first position, the supporting portion being regulated from elevating with respect to the body in a case where the movement portion is positioned at the second position, and a movement regulation unit regulating that the movement portion moves to the second position.

Further features of the present invention will become apparent from the following description of exemplary embodiments with reference to the attached drawings.

BRIEF DESCRIPTION OF THE DRAWINGS

FIG. 22 is a table showing an ON/OFF pattern of first and second switches.

DESCRIPTION OF THE EMBODIMENTS

First Embodiment

Figure 1:
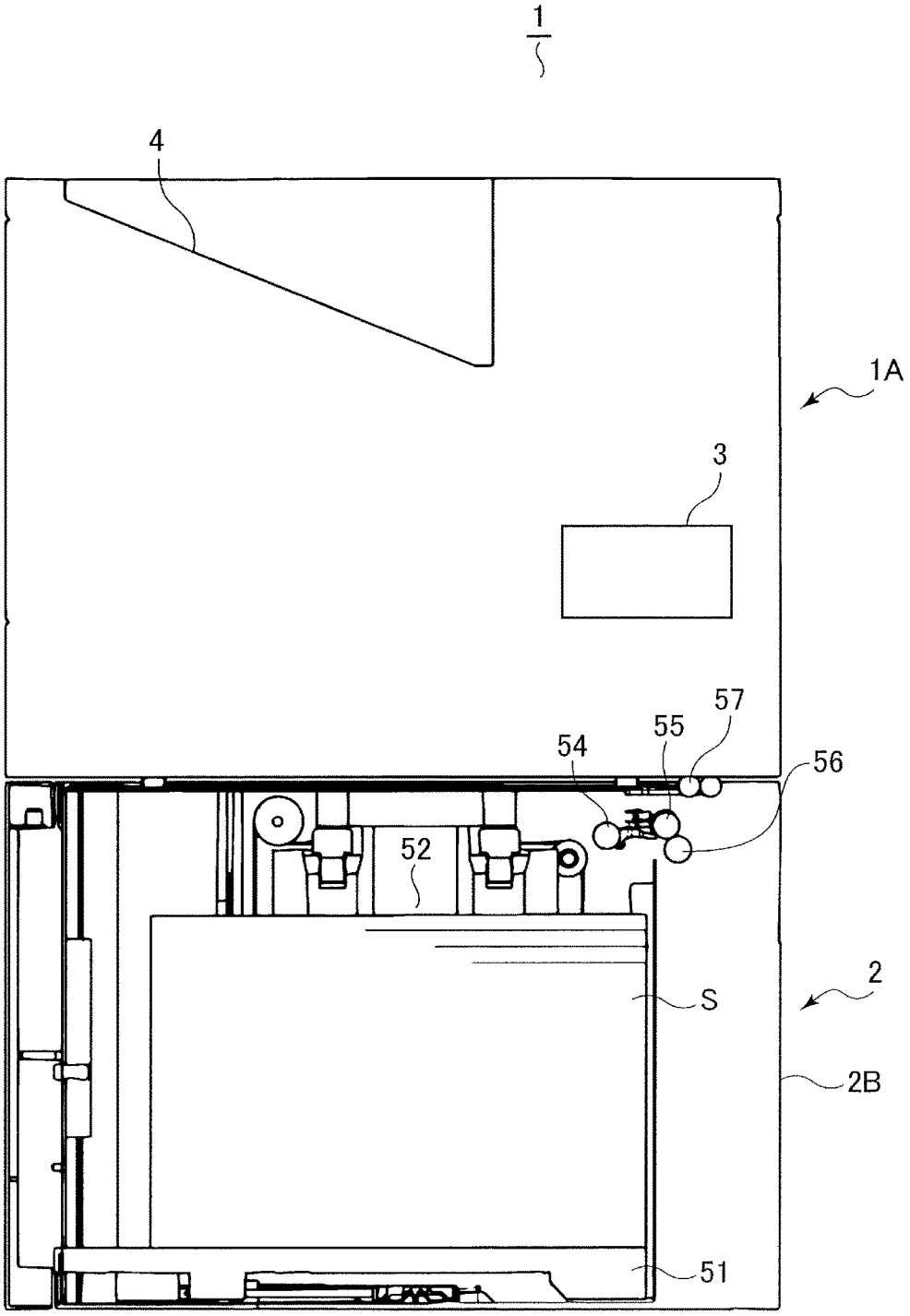
FIG. 1 is a general schematic view of a printer according to a first embodiment of the present invention.
Figure 2:
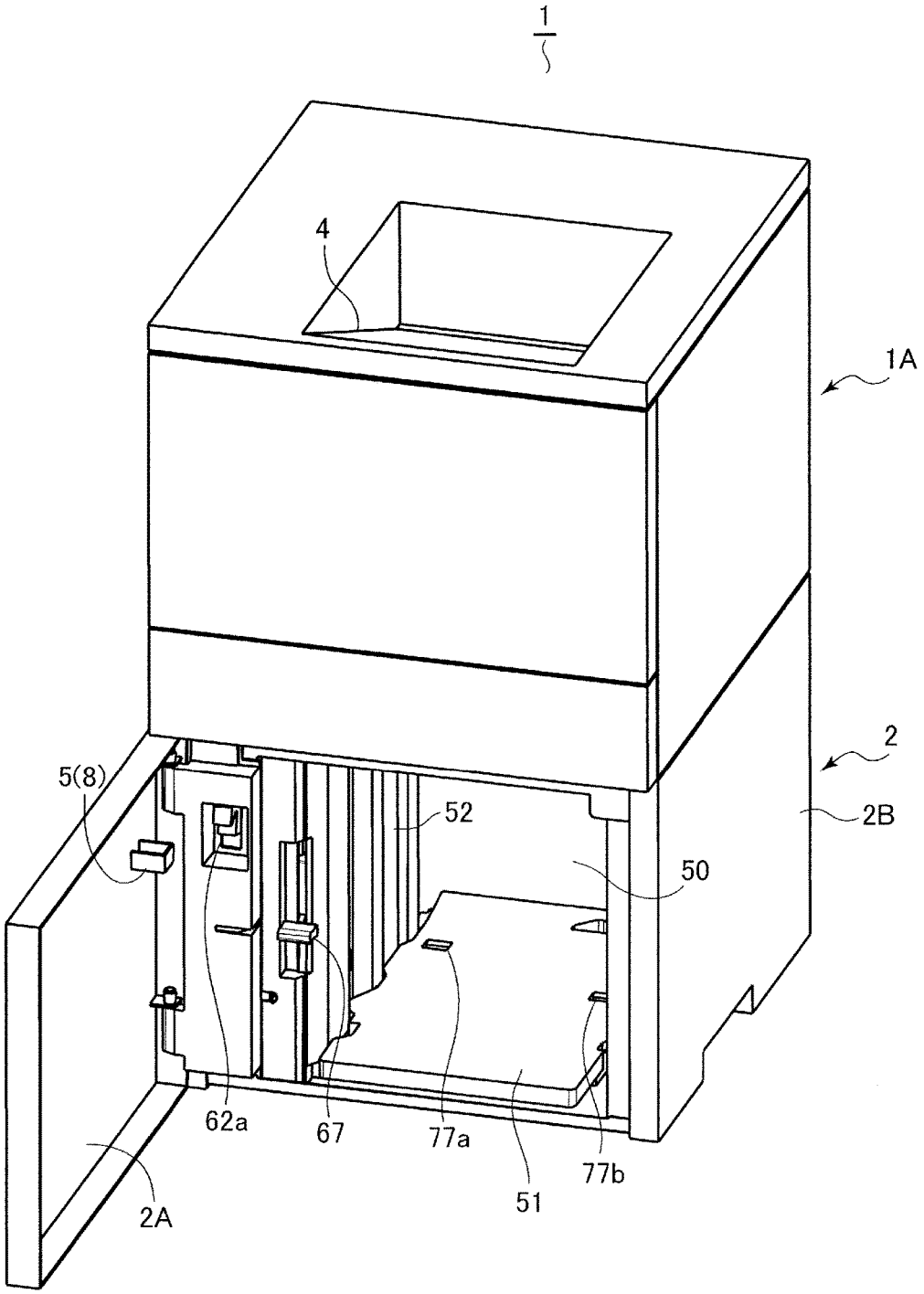
FIG. 2 is a general perspective view of a printer in a state where a door is opened.

A printer 1, i.e., image forming apparatus, according to a first embodiment of the present invention is an electrophotographic laser beam printer. As shown in FIGS. 1 and 2, the printer 1 includes a printer body 1A and a sheet supporting apparatus 2. The sheet supporting apparatus 2 includes a casing 2B, i.e., body, and a sheet supporting base 51, i.e., supporting portion, supported in an elevating manner by the casing 2B and supporting sheets S. Further, the sheet supporting apparatus 2 includes a feeding roller 54 for feeding sheets S supported on the sheet supporting base 51, a feed roller 55, a separation roller 56, and a conveyance roller pair 57.

A sheet S supported on the sheet supporting base 51 is sent out by the feeding roller 54, separated one sheet at a time by the feed roller 55 and the separation roller 56, and conveyed by the conveyance roller pair 57 toward an image forming unit 3 of the printer body 1A. The sheet S on which images have been formed by the image forming unit 3 is discharged onto a discharge tray 4. The image forming process performed in the image forming unit 3 is well-known, and will not be described here.

Figure 3:
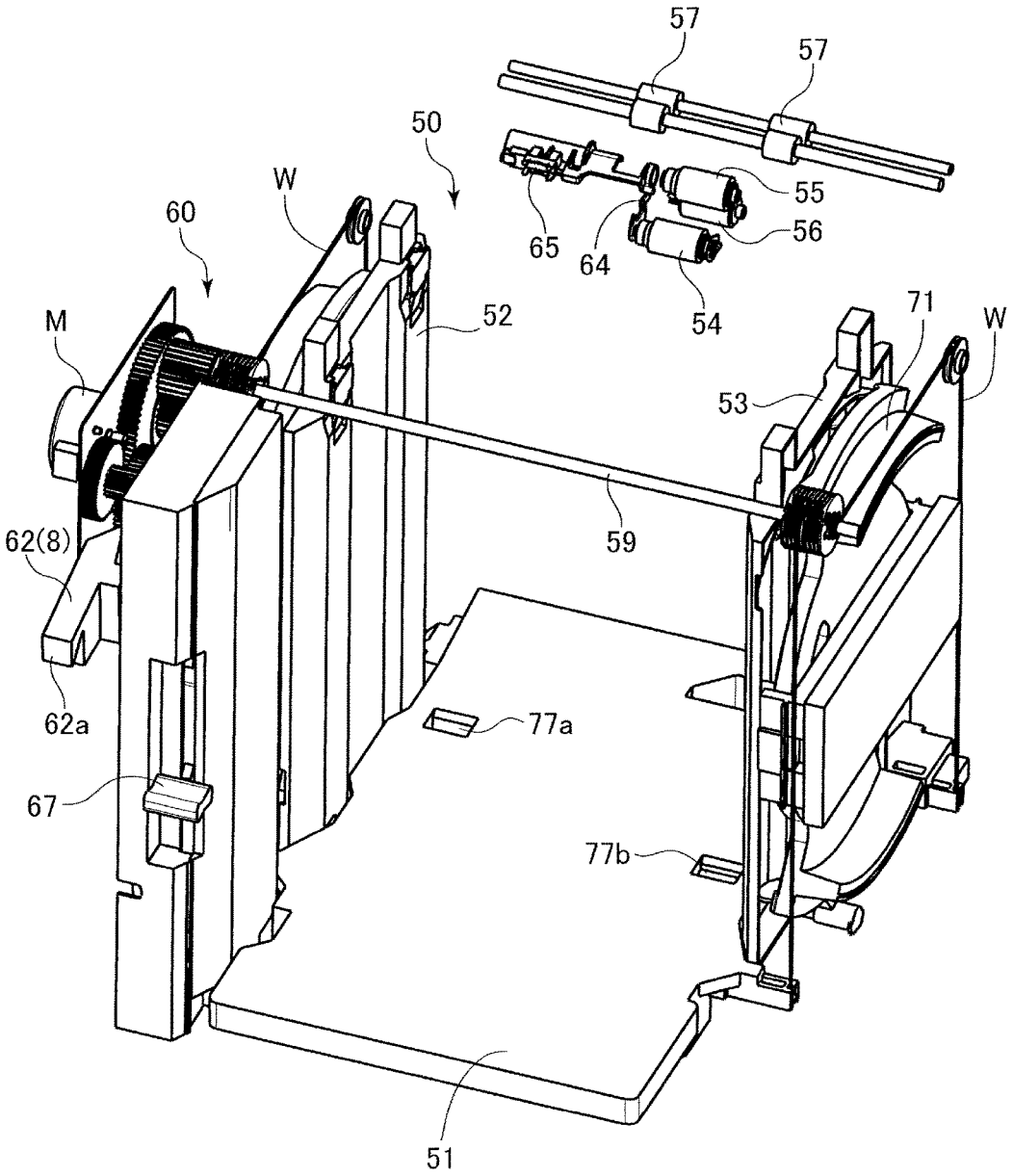
FIG. 3 is a perspective view of a sheet regulation unit and a drive unit.
Figure 4:
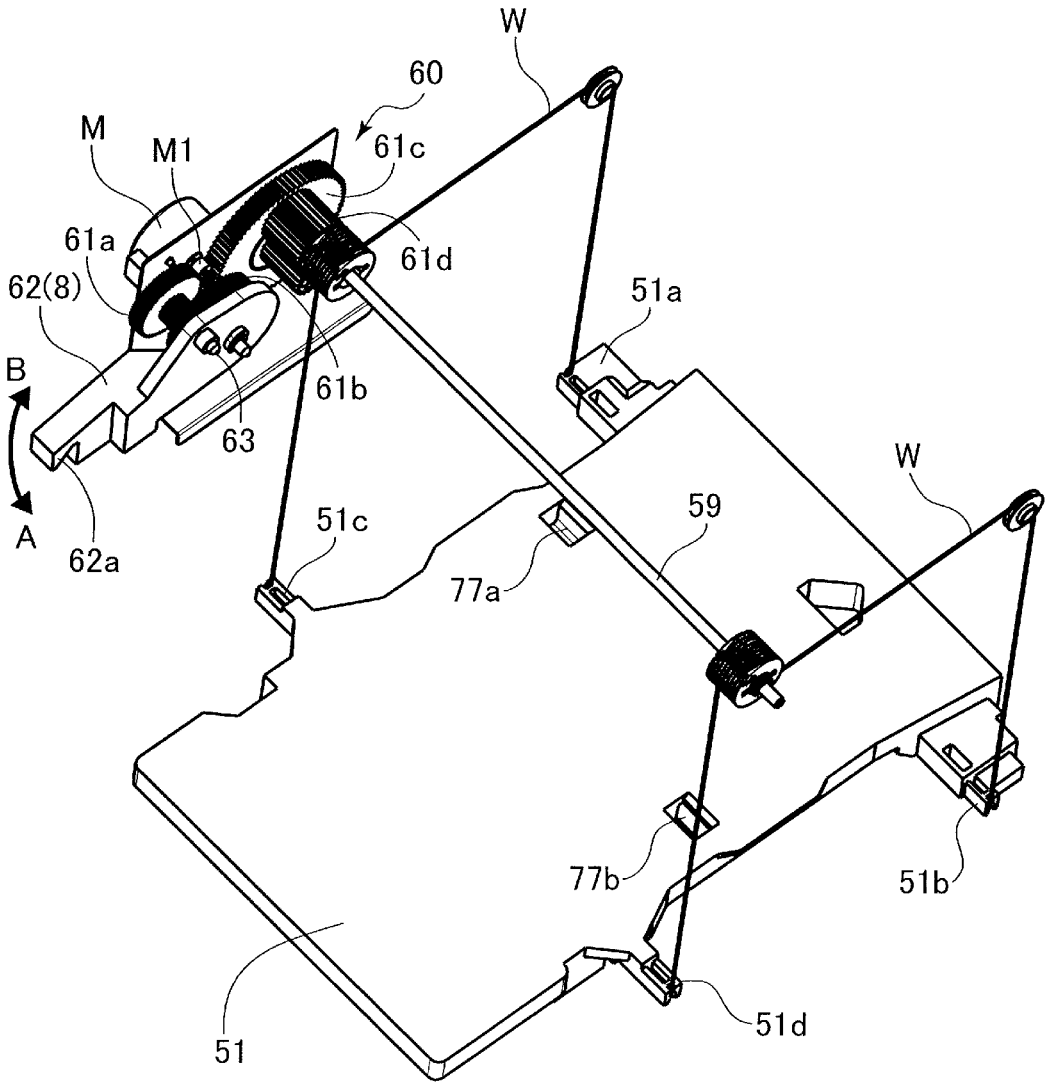
FIG. 4 is a perspective view of a drive unit and a sheet supporting base.

The sheet supporting apparatus 2 includes, as shown in FIGS. 3 and 4, a sheet regulation unit 50, i.e., sheet regulation portion, for regulating a position of a sheet supported on the sheet supporting base 51, and a drive unit 60. The drive unit 60 elevates and lowers the sheet supporting base 51 via a wire W having flexibility. The drive unit 60 includes a motor M, i.e., elevating unit, a motor gear M1, four gears 61*a*, 61*b*, 61*c* and 61*d*, a winding shaft 59, and a release member 62 retaining a gear 61*b* and pivotally disposed around a shaft 63. When the motor M is driven, the winding shaft 59 rotates via the motor gear M1 and four gears 61*a*, 61*b*, 61*c* and 61*d*, and the wire W is wound up. The ends of the wire W are respectively connected to wire suspended portions 51*a*, 51*b*, 51*c* and 51*d* disposed on the sheet supporting base 51, and the sheet supporting base 51 is elevated by having the wire W wound up.

A one-way clutch is built into the gear 61*a*, so that the gear is configured to rotate freely in a direction elevating the sheet supporting base 51, but locked and prevented from rotating in the direction lowering the sheet supporting base 51. Therefore, when the sheet supporting base 51 is elevated and maintains its height, the sheet supporting base 51 can be retained by the gear 61*a* even after the driving of the motor M is stopped, so that energy can be saved.

Further, as illustrated in FIG. 2, the sheet supporting apparatus 2 has a door 2A, i.e., door member, supported so as to open and close with respect to the casing 2B, and that exposes the sheet supporting base 51 when in an opened state. A hook portion 5 is formed on an inner side wall of the door 2A, and when the door 2A is opened to realize the opened state, the hook portion 5 pushes up a release portion 62*a* of the release member 62, and the release member 62 pivots around the shaft 63 in a direction of B illustrated in FIG. 4. Then, the meshing of the gear 61*b* retained by the release member 62 with the gears 61*a* and 61*c* is released. Further, in a state where the engagement of the hook portion 5 and the release portion 62*a* is released, the release member 62 maintains its posture by its own weight. As a result, the winding shaft 59 rotates in a direction winding out the wire W by the weight of the sheet supporting base 51 and the sheets S supported on the sheet supporting base 51, and the sheet supporting base 51 is lowered to a lowermost supporting position. A user supplies sheets to the sheet supporting base 51 in a state where the sheet supporting base 51 is lowered to the supporting position. The hook portion 5 and the release member 62 of the door 2A constitute a cutoff mechanism 8 cutting off drive transmission from the motor M to the sheet supporting base 51.

On the other hand, in a state where the door 2A is in a closed position, the hook portion 5 pushes down the release portion 62*a* of the release member 62, and the release member 62 pivots around the shaft 63 in a direction A illustrated in FIG. 4. Then, the gear 61*b* retained by the release member 62 engages with the gear 61*a* and the gear 61*c*. In this state, the drive force of the motor M can be transmitted to the winding shaft 59, winding up the wire W and elevating the sheet supporting base 51.

Figure 5:
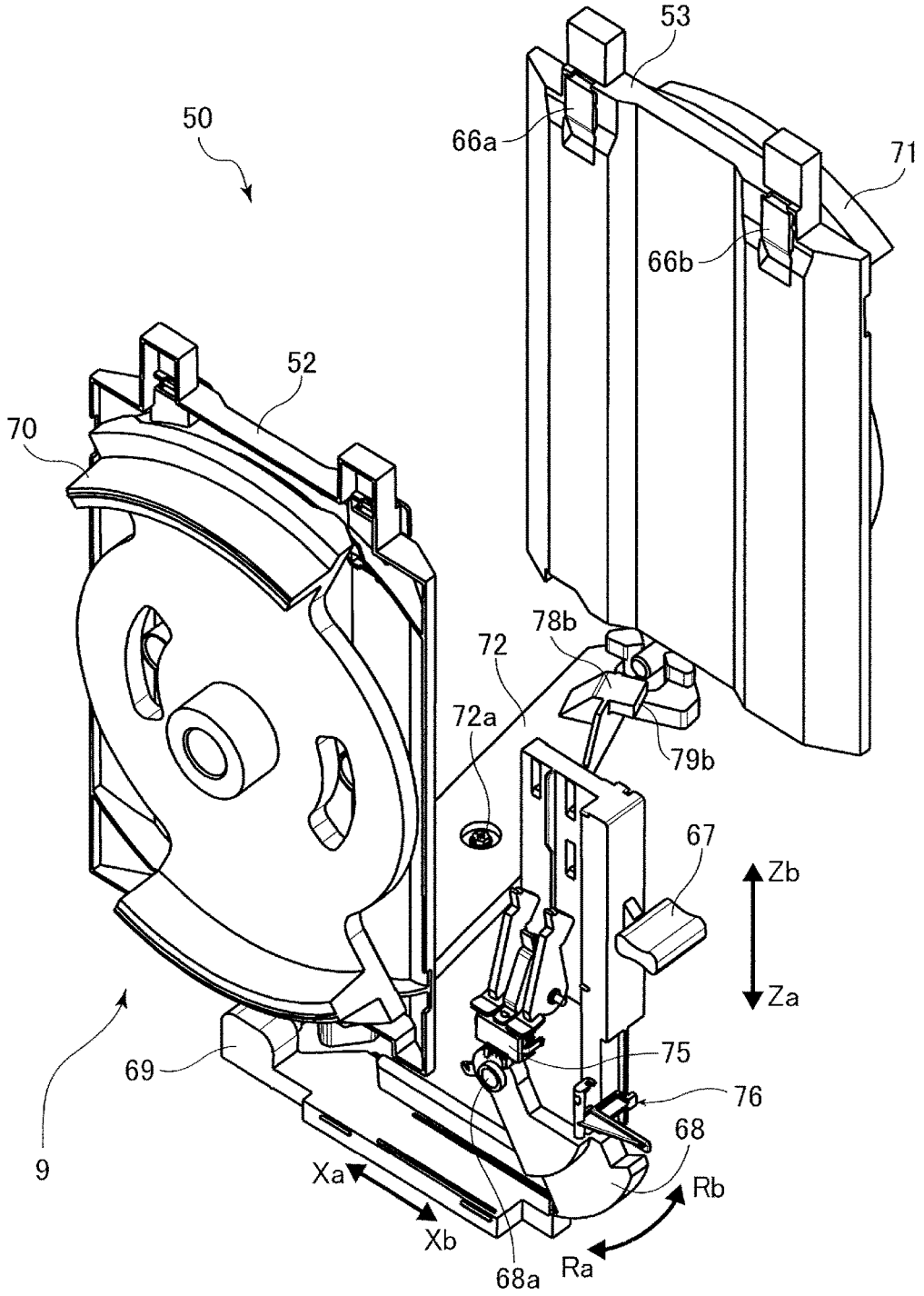
FIG. 5 is a perspective view of an operating lever and a sheet regulation unit.

Next, we will describe the sheet regulation unit 50. The sheet regulation unit 50 includes, as illustrated in FIG. 5, a rotary member 68, a slide member 69, left and right abutment members 70 and 71, i.e., first and second rotary plates, left and right side regulating plates 52 and 53, and a connecting member 72. The abutment members 70 and 71 and the connecting member 72 constitute an interlocking portion 9 interlocking the side regulating plates 52 and 53.

The side regulating plates 52 and 53 are disposed slidably in a width direction orthogonal to a sheet feeding direction, wherein the side regulating plate 52, i.e., first regulating member, regulates a position of one end, i.e., first end, in a width direction of the sheet, and the side regulating plate 53, i.e., second regulating member, regulates a position of the other end, i.e., second end, of the sheet. Width aligning plates 66*a* and 66*b* movable in the width direction are disposed on the side regulating plate 53, and the width aligning plates 66*a* and 66*b* are configured to press the sheet against the side regulating plate 52 via a spring not shown.

The rotary member 68 interlocks with an operating lever 67, i.e., movement portion, and when the operating lever 67 is moved toward a direction of arrow Za, the rotary member is pushed by the operating lever 67 and rotates in a direction of arrow Ra. The slide member 69 is engaged to the rotary member 68, and when the rotary member 68 moves in the direction of arrow Ra, the slide member moves toward a direction of arrow Xa.

The abutment members 70 and 71 are supported rotatably on the casing 2B, and are connected by the connecting member 72 similarly supported rotatably on the casing 2B around a rotation fulcrum 72*a*. When the slide member 69 moves in the direction of arrow Xa or arrow Xb, the abutment member 70 connected to the slide member 69 rotates. When the abutment member 70 on the left side rotates, the abutment member 71 on the right side rotates via the connecting member 72 counterwise as (opposite direction to the direction of rotation of) the left-side abutment member 70 on the left side.

Projecting portions 78*a* and 78*b*, i.e., elevation regulating portions, disposed below the sheet supporting base 51 and projecting upward are formed to the connecting member 72 (refer to FIGS. 5 and 6A). The projecting portions 78*a* and 78*b* respectively have projections 79*a* and 79*b* that project toward a direction of rotation (clockwise in FIG. 5) of the connecting member 72 when the operating lever 67 is moved toward the direction of arrow Za. Engagement holes 77*a* and 77*b*, i.e., engagement portions, capable of engaging respectively with the projections 79*a* and 79*b* are formed on the sheet supporting base 51, and the sheet supporting base 51 can be locked by having the projections 79*a* and 79*b* engage with the engagement holes 77*a* and 77*b*.

In the present embodiment, the operating lever 67 is disposed movably in the vertical direction, that is, in the direction of arrows Zb and Za. A letter size position, i.e., first position, an A4 size position, i.e., third position, and a lock position, i.e., second position, are set in the range of movement of the operating lever 67, in the named order from top to bottom.

Next, the operation of the sheet regulation unit 50 in accordance with the movement of the operating lever 67 will be described with reference to FIGS. 6A through 6C. Since the left and right abutment members 70 and 71 and the left and right side regulating plates 52 and 53 are designed approximately symmetrically, only the abutment member 70 and the side regulating plate 52 disposed on the left size will be described, and description of the abutment member 71 and the side regulating plate 53 disposed on the right side will be omitted. The side regulating plate 53 is interlocked with the side regulating plate 52, and moved to a direction opposite to the direction of movement of the side regulating plate 52 in the width direction of the sheet.

The side regulating plate 52 has a regulation surface 52*a*, i.e., first or second regulation surface, regulating a position of one end of the sheet in the width direction, and a rib shape 74, i.e., first or second cam surface, formed on a side opposite from the regulation surface 52*a*. The rib shape 74 has an inclined plane 74*a* inclined to protrude toward the abutment member 70. Further, the abutment member 70 has a projection 73 projected toward the side regulating plate 52, and the projection 73 has an inclined plane 73*a* formed approximately in parallel with the inclined plane 74*a* of the rib shape 74. In the present embodiment, a plurality of rib shapes 74 and projections 73 are provided, but the number can be one each, or a large number determined as needed.

Figure 6A:
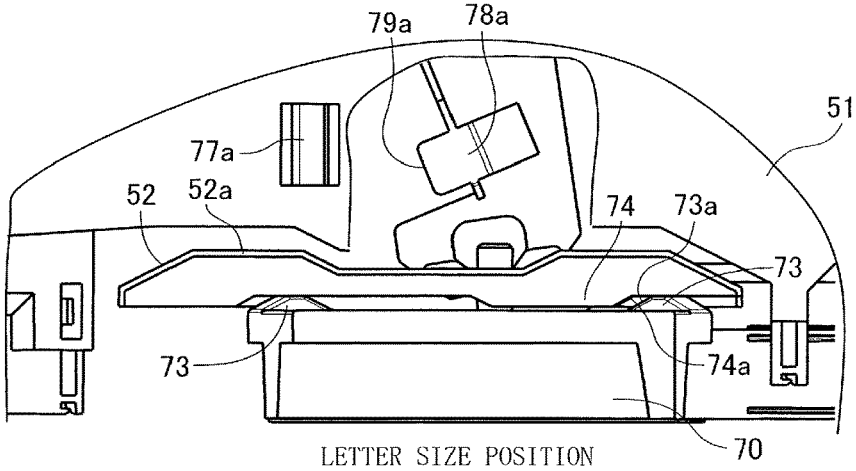
FIG. 6A is a plan view of a side regulating plate and a projecting portion in a state where the operating lever is at a letter size position.

Now, FIG. 6A illustrates the state of the side regulating plate 52 and the abutment member 70 when the operating lever 67 is positioned at the letter size position. In this state, the projection 73 on the abutment member 70 is separated from the rib shape 74 of the side regulating plate 52, and the side regulating plate 52 is positioned at a first sheet regulating position regulating the position of a letter size, i.e., first size, sheet in the width direction together with the other side regulating plate 53.

Figure 6B:
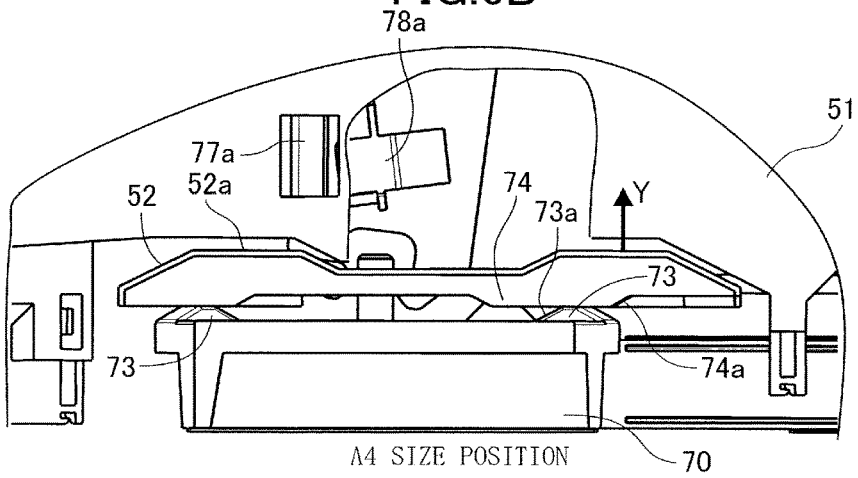
FIG. 6B is a plan view of a side regulating plate and a projecting portion in a state where the operating lever is at an A4 size position.

FIG. 6B illustrates the state of the side regulating plate 52 and the abutment member 70 when the operating lever 67 is positioned at the A4 size position. In this state, the projection 73 of the abutment member 70 presses the rib shape 74 of the side regulating plate 52, and the side regulating plate 52 is positioned at a second sheet regulating position regulating the position of an A4 size, i.e., second size, sheet in the width direction together with the other side regulating plate 53. That is, during the process in which the operating lever 67 moves from the letter size position to the A4 size position, the inclined plane 73*a* of the projection 73 of the abutment member 70 engages with the inclined plane 74*a* of the rib shape 74 of the side regulating plate 52. Then, the projection 73 presses the rib shape 74 smoothly, and the side regulating plate 52 is moved toward the direction approximating the other side regulating plate 53.

In the state where the operating lever 67 is positioned at the above-described letter size position or the A4 size position, the projecting portions 78*a* and 78*b* formed to the connecting member 72 are positioned at an elevation permissible position where the portions are not engaged with the engagement holes 77*a* and 77*b* formed on the sheet supporting base 51. In this state, the elevation of the sheet supporting base 51 is permitted.

Figure 6C:
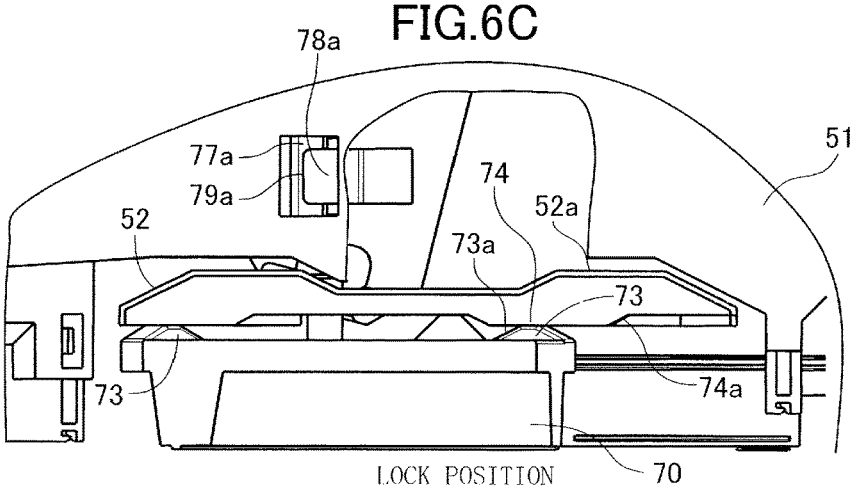
FIG. 6C is a plan view of a side regulating plate and a projecting portion in a state where the operating lever is at a lock position.

FIG. 6C illustrates the state of the side regulating plate 52 and the abutment member 70 in the state where the operating lever 67 is positioned at the lock position. In this state, the projection 73 of the abutment member 70 presses the rib shape 74 of the side regulating plate 52, and the side regulating plate 52 is positioned at the second sheet regulating position regulating the width direction position of the A4 size sheet together with the other side regulating plate 53. Further, the projecting portions 78*a* and 78*b* formed to the connecting member 72 are positioned at an elevation regulating position where the projections 79*a* and 79*b* are respectively engaged with the engagement holes 77*a* and 77*b* formed to the sheet supporting base 51, by which the elevation of the sheet supporting base 51 is regulated.

The engagement holes 77*a* and 77*b* have recessed grooves recessed in a clockwise direction in FIG. 5 on the connecting member 72, and a hole is opened upward from each of the recessed grooves. By adopting such engagement holes 77*a* and 77*b*, a user can confirm the state in which the projections 79*a* and 79*b* are engaged to the engagement holes 77*a* and 77*b* from above, and thus, usability of the apparatus can be improved.

Figure 7:
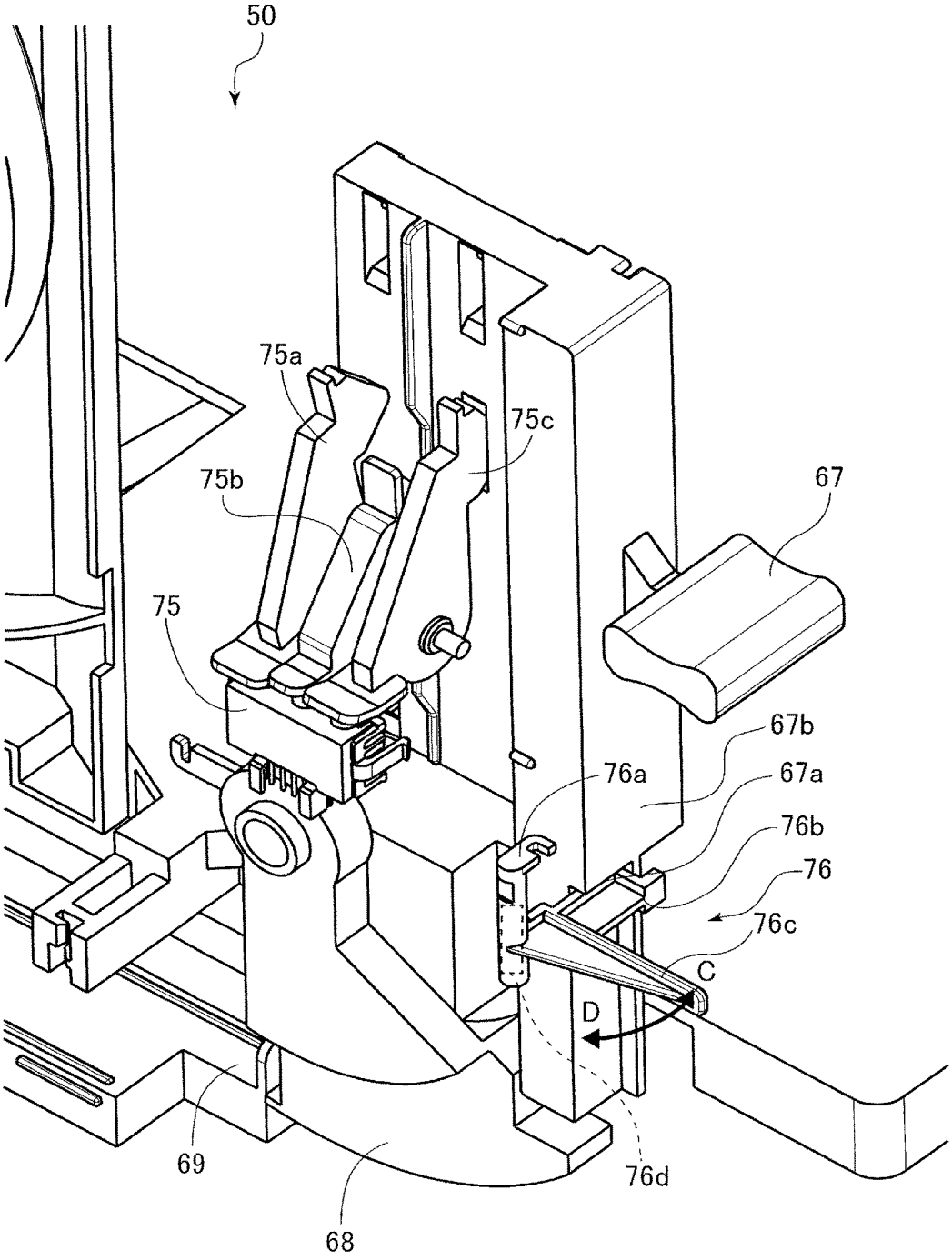
FIG. 7 is a perspective view of a switch and a movement regulation unit.

On the other hand, as illustrated in FIG. 7, the sheet supporting apparatus 2 has a switch 75, i.e., detection portion, detecting that the elevation of the sheet supporting base 51 is regulated. Actually, the switch 75 detects the position of the operating lever 67 through three levers 75*a*, 75*b* and 75*c*. The operating lever 67 has holes formed thereto, into which either one of the levers 75*a*, 75*b* or 75*c* fall, the holes respectively corresponding to the letter size position, the A4 size position and the lock position. The switch 75 can detect the position of the operating lever 67 by detecting the movement of the levers 75*a*, 75*b* and 75*c*.

Further, the sheet supporting apparatus 2 has a movement regulation unit 76 regulating the operating lever 67 from moving to the lock position from the A4 size position. The movement regulation unit 76 pivots around the pivot shaft 76*a*, and has a movement regulation portion 76*b* capable of abutting against a stepped portion 67*a* formed integrally with the operating lever 67, and a lever portion 76*c*, i.e., operating portion, pivoting integrally with the movement regulation portion 76*b*. The movement regulation portion 76*b* is disposed movably between a regulating position (position illustrated in FIG. 7) regulating the operating lever 67 from moving to the lock position from the A4 size position, and a permissible position permitting the operating lever 67 to move to the lock position from the A4 size position. Moreover, the movement regulation unit 76 has a spring 76*d*, i.e., biasing member, biasing the movement regulation portion 76*b* toward the regulating position (toward arrow C).

Figure 8:
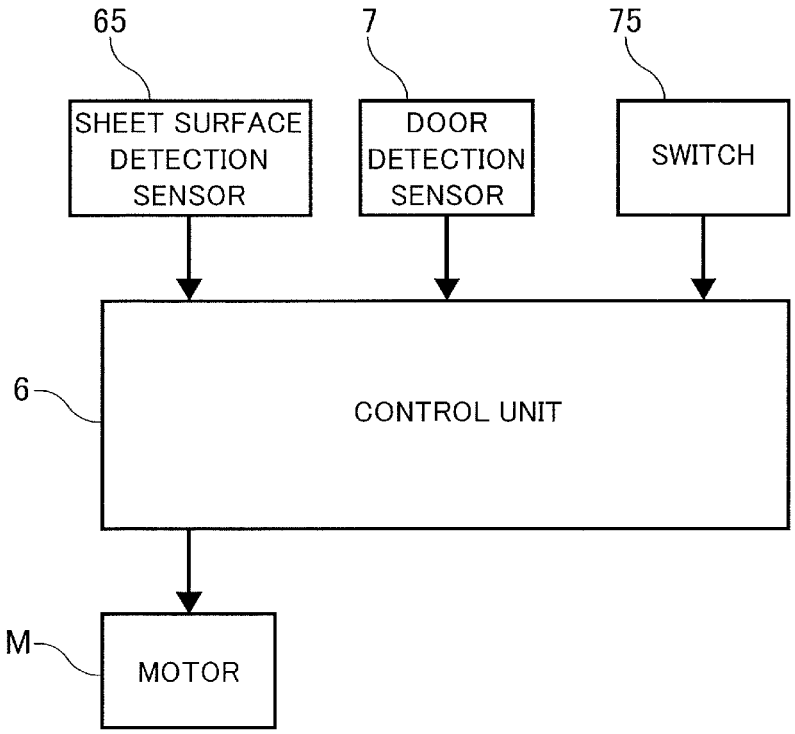
FIG. 8 is a control block diagram according to a first embodiment.

Now, a control unit 6 of the printer 1 will be described with reference to a control block diagram illustrated in FIG. 8. The control unit 6 includes a CPU, a ROM, a RAM and so on. A sheet surface detection sensor 65 detecting an uppermost sheet position in a bundle of sheets supported on the sheet supporting base 51, a door detection sensor 7, and a switch 75 described later are connected to an input side of the control unit 6. A motor M is connected to an output side of the control unit 6.

Next, the action of the sheet supporting apparatus 2 will be described. When carrying out a printing operation, the user sets the door 2A to a closed state. The control unit 6 drives the motor M when the door detection sensor 7 detects the closed state of the door 2A, and the switch 75 detects that the operating lever 67 is not in the lock position. Thereby, the winding shaft 59 rotates in a direction winding up the wire W, and the sheet supporting base 51 elevates. Then, the uppermost sheet in the bundle of sheets supported on the sheet supporting base 51 pushes a sheet surface detection flag 64 (refer to FIG. 3) upward, and the sheet surface detection sensor 65 is turned on. When a feed signal is transmitted from an operation panel of the printer body 1A or a PC and the like in a state where the sheet surface detection sensor 65 is turned on, the control unit 6 rotates the feeding roller 54, and sheets are fed.

Along with the reduction of the bundle of sheets accompanying the feeding of sheets, the sheet surface detection flag 64 pivots downward, and the sheet surface detection sensor 65 is turned off. When the sheet surface detection sensor 65 is turned off, the control unit 6 rotates the motor M and lifts the sheet supporting base 51 until the sheet surface detection sensor 65 is turned on. As described, the sheets S supported on the sheet supporting base 51 can be fed by the feeding roller 54 through repeated elevation of the sheet supporting base 51.

When the door detection sensor 7 detects that the door 2A is in a closed state, and the switch 75 detects that the operating lever 67 is in the lock position, the control unit 6 controls the motor M so that the sheet supporting base 51 is not elevated.

Next, the user opens the door 2A when supplying sheets S to the sheet supporting base 51. When the door 2A is in an opened state, the hook portion 5 pivots the release member 62 in the direction of arrow B (refer to FIG. 4), and thereby, the drive transmission from the drive unit 60 to the sheet supporting base 51 is released. Thus, the sheet supporting base 51 is lowered to the supporting position by its own weight and the weight of the sheets S supported thereon.

The user moves the operating lever 67 in accordance with the size of the sheet being supplied. For example, when the user supplies A4 size sheets in replacement of LTR sized sheets, the user moves the operating lever 67 from the letter size position to the A4 size position. When the operating lever 67 is moved from the letter size position to the A4 size position, the rotary member 68, the slide member 69, the abutment member 70, the connecting member 72 and the abutment member 71 are moved in interlocked manner. Then, the side regulating plates 52 and 53 are pressed by the abutment members 70 and 71, and the side regulating plates 52 and 53 are moved to a second sheet regulating position regulating the position of A4 size sheets in the width direction. In this state, the user places the A4 size sheets on the sheet supporting base 51. It is also possible to move the operating lever 67 from the letter size position to the A4 size position after placing the A4 size sheets on the sheet supporting base 51.

Next, during transportation and the like, in order to lock the sheet supporting base 51, the user or a supplier sets the door 2A to the opened state, and moves the operating lever 67 from the A4 size position to the lock position. At this time, since the movement regulation portion 76*b* is positioned at the regulating position by the spring 76*d*, the operating lever 67 is regulated from being moved to the lock position. Thereby, it becomes possible to prevent the user from erroneously moving the operating lever 67 to the lock position, so that the user does not have to be careful when moving the operating lever 67, so that the usability can be improved.

In order to position the operating lever 67 at the lock position, the user or the supplier pivots the lever portion 76*c* in the direction of arrow D illustrated in FIG. 7 against the biasing force of the spring 76*d*. Thereby, the movement regulation portion 76*b* pivots integrally with the lever portion 76*c*, and the movement regulation portion 76*b* is positioned at the permissible position. In this state, the user or the supplier can move the operating lever 67 to the lock position, so as to lock the sheet supporting base 51 to the connecting member 72. Thus, it becomes possible to prevent the sheet supporting base 51 from shaking and colliding against the casing 2B and possibly causing damage to the sheet supporting base 51 and the casing 2B when the printer 1 is being transported. Since the direction of operation of the operating lever 67 and the direction of operation of the lever portion 76*c* differ, the user will not perform erroneous operation easily.

In the state where the operating lever 67 is positioned at the lock position, the control unit 6 controls the motor M so that the sheet supporting base 51 will not elevate, based on the detection result of the switch 75.

When moving the operating lever 67 from the lock position to the A4 size position or the letter size position, the user or the supplier can move the operating lever 67 without operating the lever portion 76*c*. That is, in the state where the operating lever 67 is positioned at the lock position, the movement regulation portion 76*b* is placed on the surface of a flat plane 67*b* of the operating lever 67 (refer to FIG. 7), and the movement regulation portion 76*b* does not regulate the movement of the operating lever 67 from the lock position to the A4 size position.

When the operating lever 67 is moved from the lock position to the A4 size position or the letter size position, a biasing force of the spring 76*d* causes the movement regulation portion 76*b* to automatically return to the regulating position. As described, when moving the operating lever 67 from the lock position to the A4 size position or the letter size position, the user or the supplier can operate the lever with one hand, and the usability can be enhanced.

The positions of different sized sheets, such as the letter size and A4 size sheets, can be regulated by operating a single operating lever 67, and in addition, the sheet supporting base 51 can be locked, so that a sheet supporting apparatus that is compact in size and having superior operability can be provided.

According to the present embodiment, the control unit 6 is disposed on the printer body 1A, but the control unit can be disposed on the sheet supporting apparatus 2. Further, it is possible to have the control unit disposed on the printer body 1A and the control unit disposed on the sheet supporting apparatus 2 mutually communicate to control the motor M.

Further according to the present embodiment, the operating lever 67 is disposed movably between the letter size position, the A4 size position and the lock position, but a position for regulating a different-sized sheet can also be added. For example, a legal size position regulating a legal size sheet can be disposed between the letter size position and the A4 size position, and in that case, the lengths in the width direction of a letter size sheet and legal size sheet are the same, so there is no need to move the side regulating plates 52 and 53.

Second Embodiment

Next, a second embodiment of the present invention will be described. The second embodiment adopts a configuration where a rear end regulating plate is added to the configuration of the first embodiment, and similar configurations as the first embodiment are either not shown, or same reference numbers are assigned in the drawings. Hitherto, when the user inserted sheets to the sheet feed tray, the sheets were abutted against the rear end regulating plate regulating the rear end position of the sheets, and the sheets could not be inserted easily. In order to insert sheets avoiding the rear end regulating plate, the user had to pay attention to the direction of insertion of sheets, so that there was a drawback from the viewpoint of usability. Further, if the members in the periphery of the rear end regulating plate were increased in size so that the rear end regulating plate will not interfere with the inserted sheets, the whole apparatus (printer) had to be increased in size.

Therefore, in addition to the effect illustrated in the first embodiment, the present embodiment provides a sheet supporting apparatus 12 having improved usability, since the rear end regulating member does not obstruct the insertion of the sheets to the sheet feed tray (or the sheet supporting base) without increasing the overall size of the apparatus.

Figure 9:
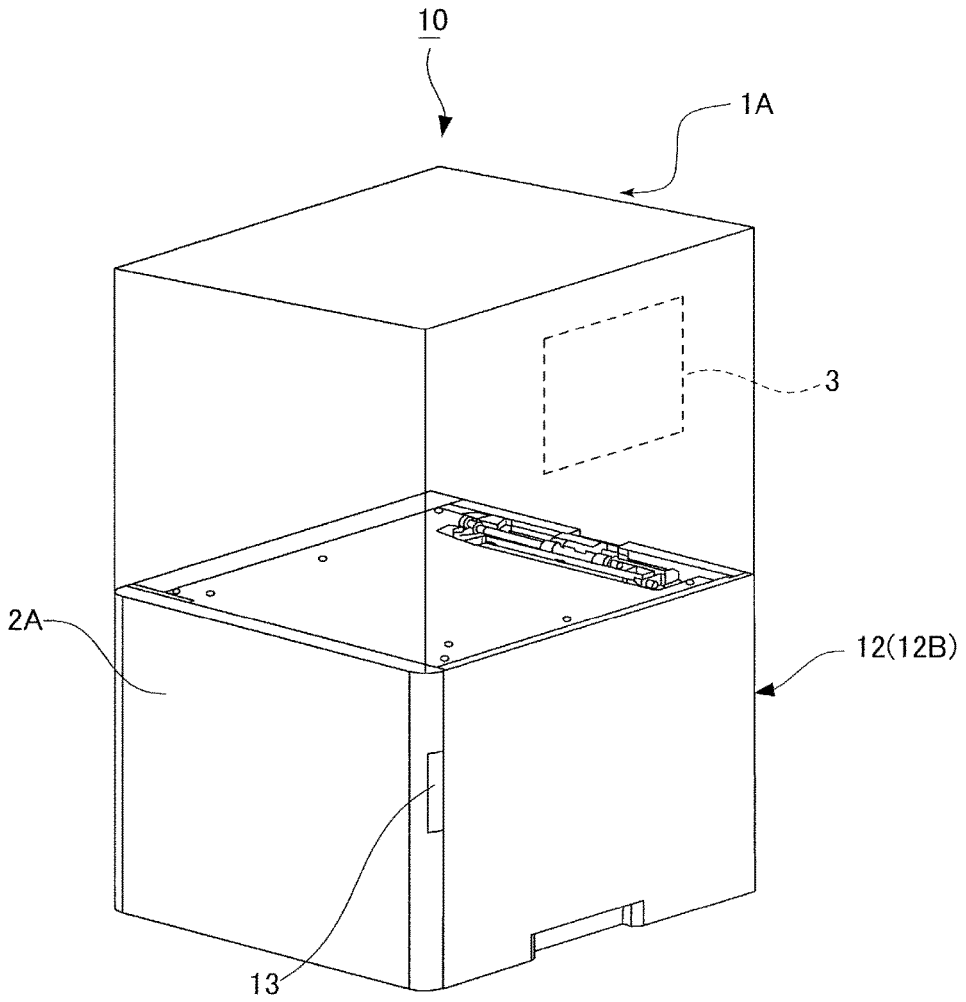
FIG. 9 is a general perspective view of a printer according to a second embodiment.

A printer 10, i.e., image forming apparatus, according to the second embodiment is an electro-photographic laser beam printer. As illustrated in FIG. 9, the printer 10 has a printer body 1A having an image forming unit 3 forming images on a sheet, and a sheet supporting apparatus 12 connected to a lower area of the printer body 1A on which sheets are supported.

Figure 10:
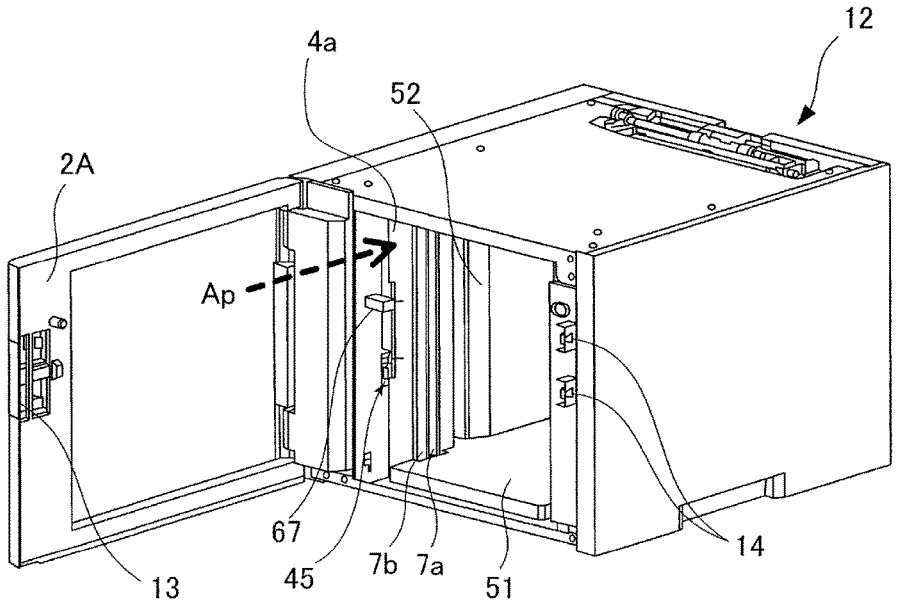
FIG. 10 is a perspective view of a sheet supporting apparatus in a state where a door is opened.

The sheet supporting apparatus 12 has a door 2A disposed on a front side of the printer 10, and the door 2A opens when a user operates a handle 13 disposed on the door 2A, exposing an interior illustrated in FIG. 10. When setting sheets in the sheet supporting apparatus 12, the user inserts a sheet bundle S to a direction of arrow Ap, i.e., first direction, illustrated in FIG. 10, and sets the sheet bundle S on the sheet supporting base 51. When the door 2A is closed by the user, the door 2A is engaged to an engagement portion 14 disposed on the sheet supporting apparatus 12 and locked.

Figure 11:
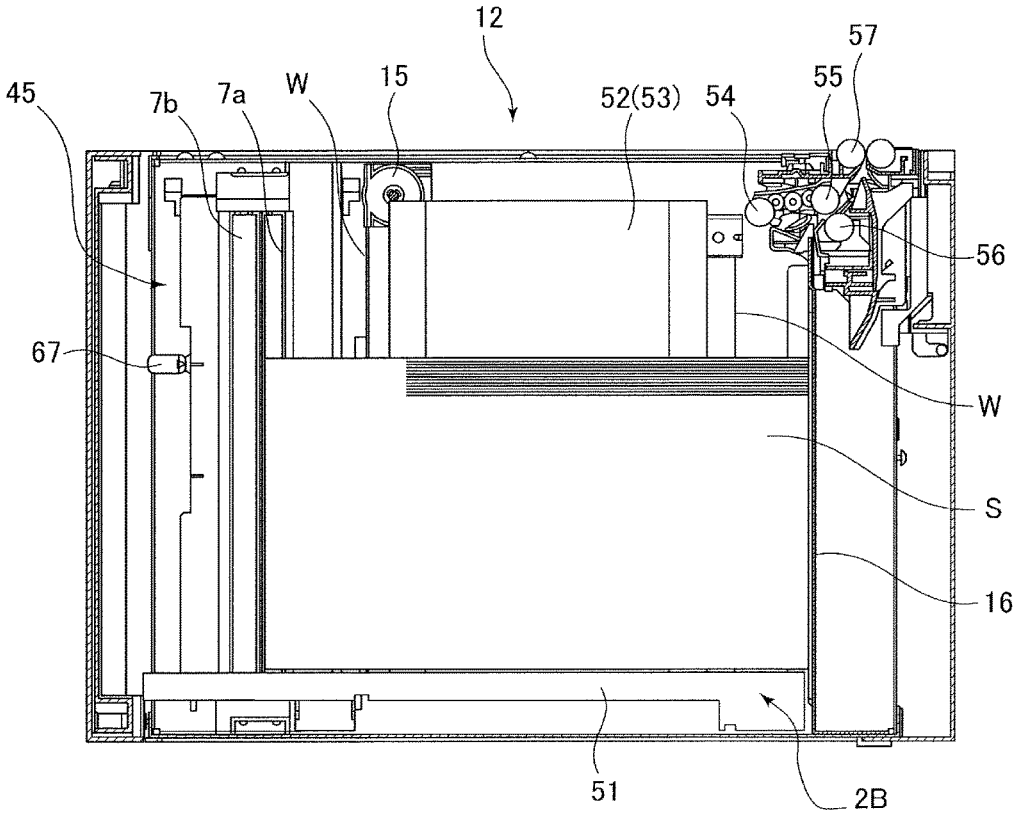
FIG. 11 is a cross-sectional view of a sheet supporting apparatus.

The sheet supporting apparatus 12 includes a casing 2B having a sheet supporting base 51 on which sheets are supported, and a pair of side regulating plates 52 and 53 regulating an end position in a width direction of the sheet, as illustrated in FIG. 11. Further, the sheet supporting apparatus 12 has rear end regulating plates 7*a* and 7*b* regulating a position at an upstream end, i.e., rear end, in a sheet feeding direction, i.e., first direction. The sheet supporting base 51 is suspended by a wire W, and the base can be elevated when a winding motor M2 (refer to FIG. 21) rotates a winding portion 15 and the wire W is wound up. The rear end regulating plates 7*a* and 7*b* are moved to positions corresponding to predetermined sheet sizes when an operating lever 67 described later is operated by a user. Further, the sheet supporting apparatus 12 has a front end regulating plate 16 regulating a position on a downstream end, i.e., front end, in the sheet feeding direction, a movement mechanism 50 moving the rear end regulating plates 7*a* and 7*b*, a feeding roller 54, a feed roller 55, a separation roller 56, and a conveyance roller pair 57.

As illustrated in FIG. 10, the sheet supporting apparatus 12 has a left wall surface 4*a*, i.e., first wall surface, and a right wall surface not shown, i.e., second wall surface, respectively opposing to both end portions in the width direction of the sheet supported on the sheet supporting base 51. The rear end regulating plates 7*a* and 7*b* and the movement mechanism 50 are disposed on the side close to the door 2A of the left wall surface 4*a*. The rear end regulating plates 7*a* and 7*b* and the movement mechanism 50 should merely be disposed in a concentrated manner on either the left wall surface 4*a* or the right wall surface, and for example, they can be disposed on the right wall surface.

When a feed signal is output from a CPU 100 of the printer 1 (refer to FIG. 21), the winding motor M is driven, and the sheet supporting base 51 is elevated by having a winding portion 11 wind up wires 41 and 42. When an upper surface of the sheet bundle S supported on the sheet supporting base 51 is elevated to a predetermined position, an uppermost sheet in the sheet bundle S is fed by the feeding roller 54. The sheet fed by the feeding roller 54 is separated one sheet at a time by the feed roller 55 and the separation roller 56, and further conveyed toward the image forming unit 3 of the printer body 1A by the conveyance roller pair 57. The feeding roller 54, the feed roller 55, the separation roller 56 and the conveyance roller pair 57 are driven by a feeding motor M3 (refer to FIG. 21). Then, an image is formed on the sheet by the image forming unit 3, and discharged to the exterior. The image forming process performed by the image forming unit 3 is well known, so that it will not be described here.

Next, a sheet regulation unit 45 will be described in detail. The present embodiment adopts a configuration where the operating lever 67 does not have a lock position as described in embodiment 1, but it can also adopt a configuration where a lock position is provided in addition to the letter size position and the A4 size position. The movements of the side regulating plates 52 and 53 when the operating lever 67 is moved between the letter size position and the A4 size position will not be described, since they have already been described in the first embodiment.

Figure 12A:
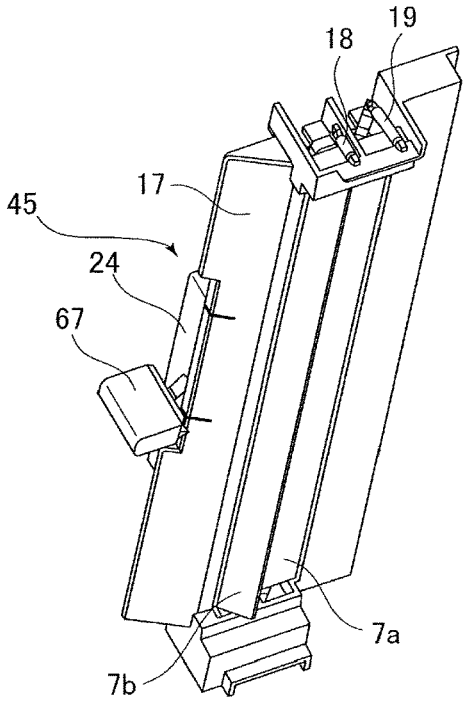
FIG. 12A is a perspective view of a sheet regulation unit seen from above.
Figure 12B:
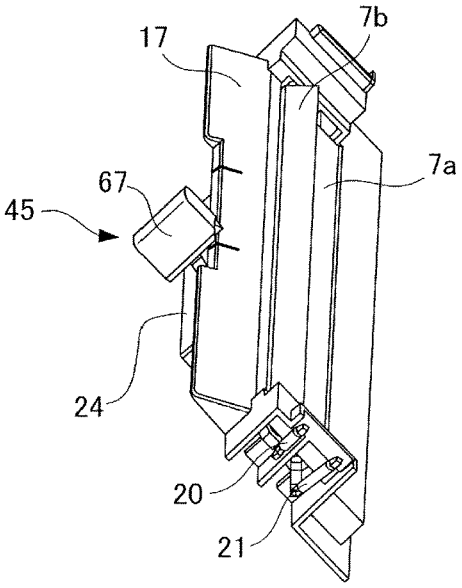
FIG. 12B is a perspective view of the sheet regulation unit seen from below.
Figure 13:
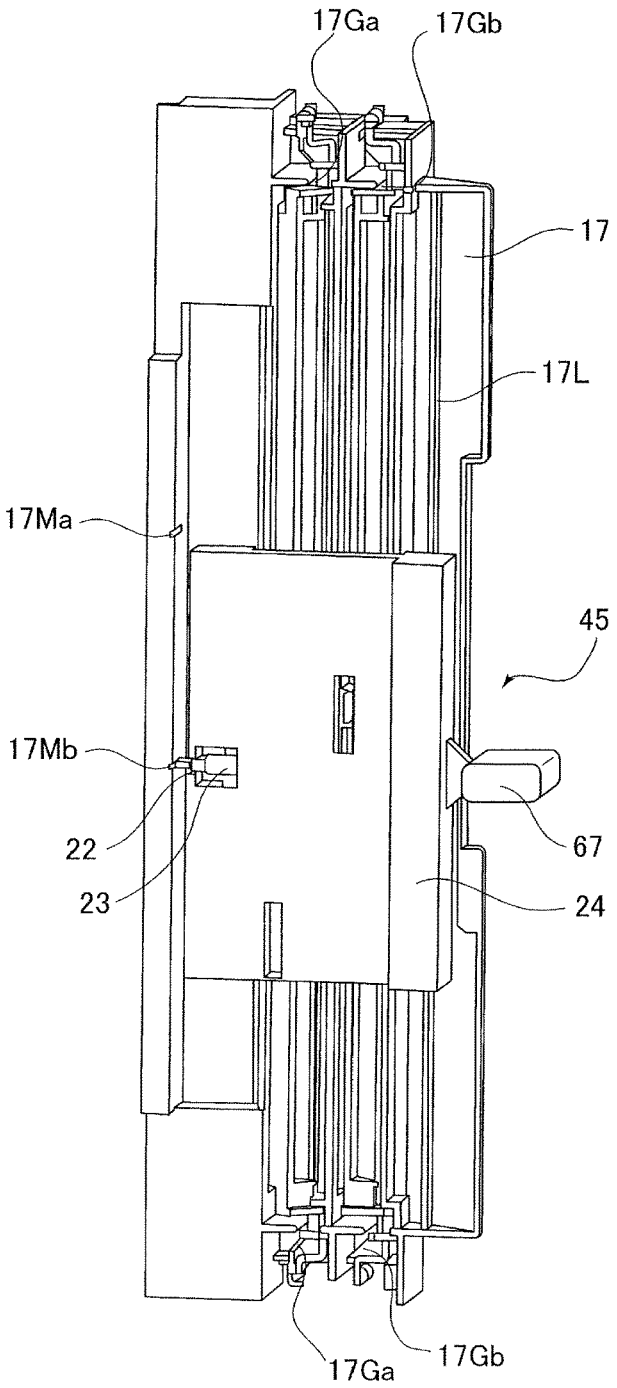
FIG. 13 is a side view of the sheet regulation unit.
Figure 14A:
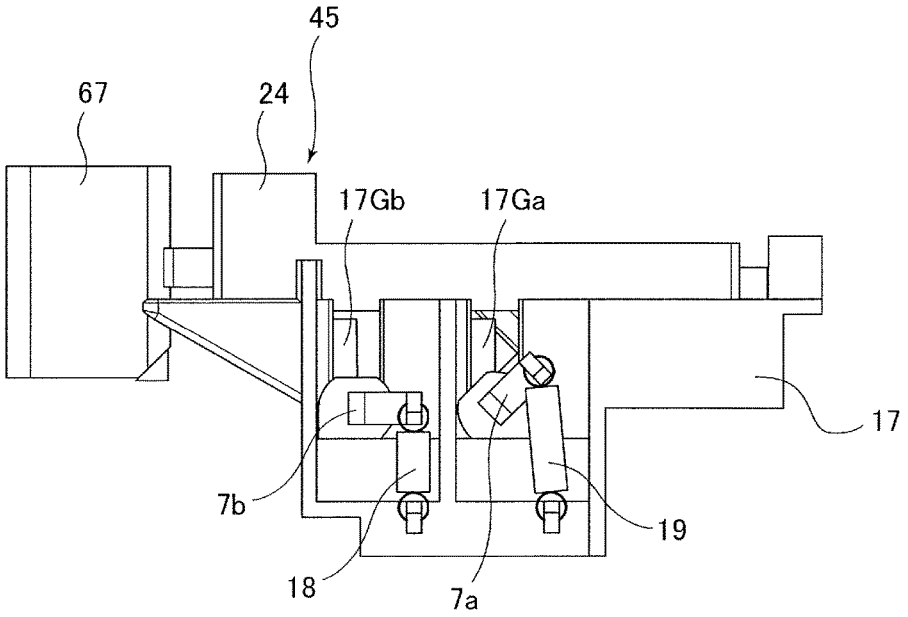
FIG. 14A is a plan view of the sheet regulation unit.
Figure 14B:
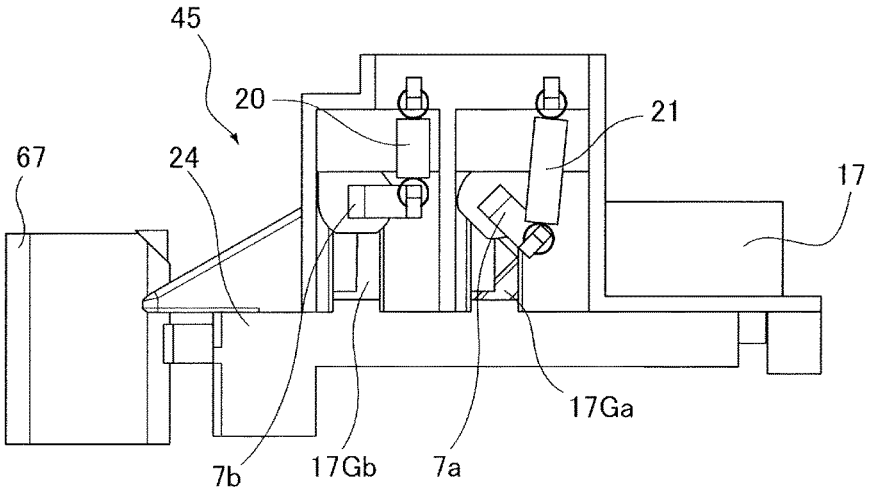
FIG. 14B is a bottom view of the sheet regulation unit.

As illustrated in FIGS. 12 and 13, the sheet regulation unit 45 includes a movement member 24 on which the operating lever 67 is integrally formed, and a rear end regulating holder 17, wherein rear end regulating plates 7*a* and 7*b* are nipped between the movement member 24 and the rear end regulating holder 17. The rear end regulating holder 17 has a guide rail 17L guiding the movement member 24 in a vertical direction, and click grooves 17Ma and 17Mb disposed respectively at upper and lower portions. The movement member 24 moves in the vertical direction along the guide rail 17L when the user operates the operating lever 67 manually. The movement member 24 has a click pin 22 being biased by a compression spring 23 and supported movably, and the movement member 24 is positioned by having the click pin 22 fit to the upper click groove 17Ma or the lower click groove 17Mb.

As illustrated in FIGS. 12 through 14B, the rear end regulating plate 7*a*, i.e., first regulating member or first upstream end regulating member, is pivotally and slidably supported on guide grooves 17Ga and 17Ga respectively disposed on upper and lower end portions of the rear end regulating holder 17. Tension springs 19 and 21, i.e., biasing members or first biasing members, are disposed between the upper and lower ends of the rear end regulating plate 7*a* and the rear end regulating holder 17, and the rear end regulating plate 7*a* is biased by the tension springs 19 and 21 toward the direction of the arrow in FIG. 15. Further, the rear end regulating plate 7*a* is biased in a direction approximating the sheet supporting base 51 by the tension springs 19 and 21, and biased to a regulating position described later.

Similarly, the rear end regulating plate 7*b*, i.e., second regulating member or second upstream end regulating member, is pivotally and slidably supported on guide grooves 17Gb and 17Gb respectively disposed on upper and lower end portions of the rear end regulating holder 17. Tension springs 18 and 20, i.e., biasing members or second biasing members, are disposed between the upper end lower ends of the rear end regulating plate 7*b* and the rear end regulating holder 17, and the rear end regulating plate 7*b* is biased by the tension springs 18 and 20 toward the direction of the arrow in FIG. 15. Further, the rear end regulating plate 7*a* is biased in a direction approximating the sheet supporting base 51 by the tension springs 18 and 20, and biased to the regulating position described later.

Figure 15:
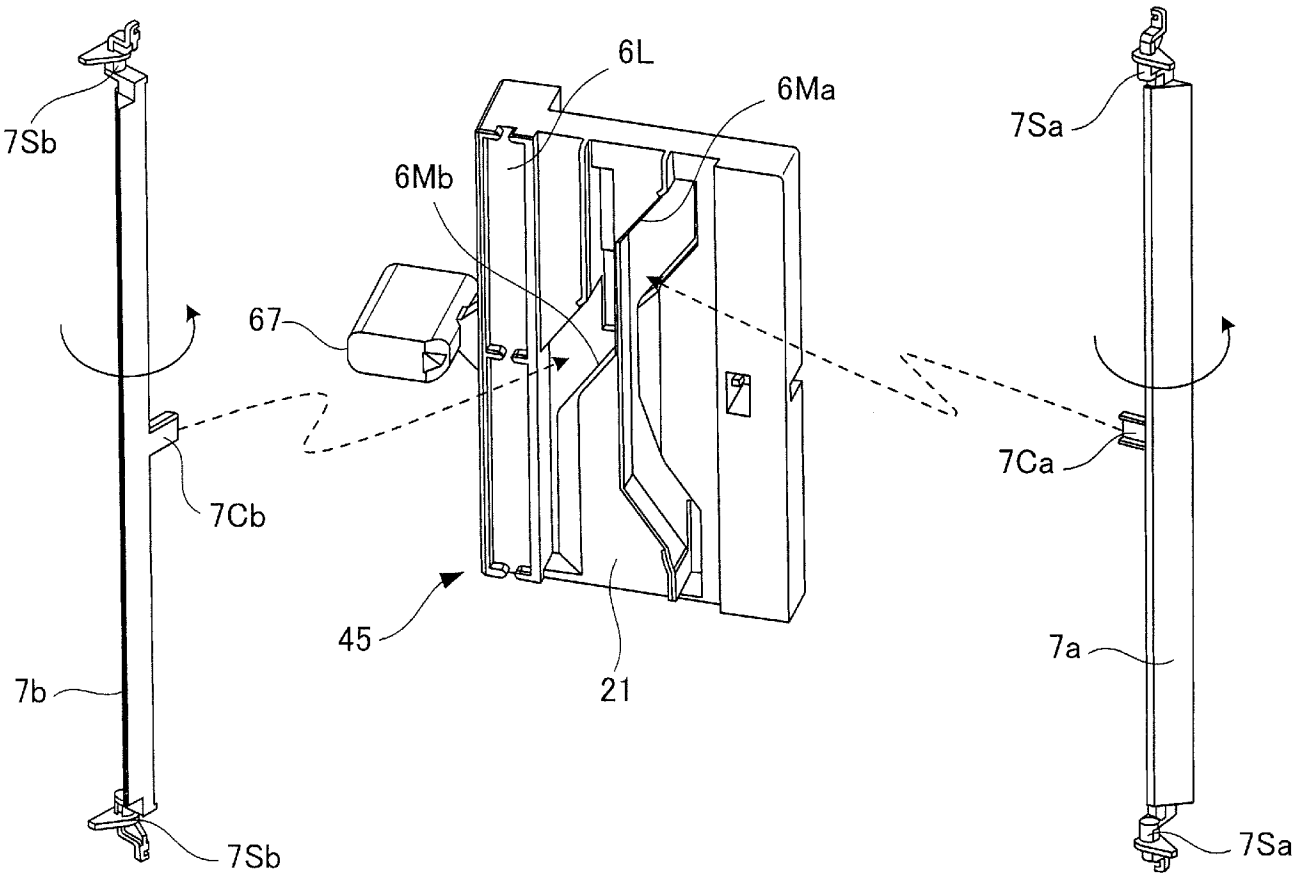
FIG. 15 is an exploded perspective view of the sheet regulation unit.

As illustrated in FIG. 15, the movement member 24 includes a cam groove 6Ma engaged to a rib 7Ca disposed at a center portion of the rear end regulating plate 7*a*, and a cam groove 6Mb engaged to a rib 7Cb disposed at a center portion of the rear end regulating plate 7*b*. In the rear end regulating plate 7*a*, the rib 7Ca is engaged to the cam groove 6Ma by the movement member 24 moving in the vertical direction along the guide rail 17L, and the rotation posture around a rotation shaft 7Sa is regulated. In the rear end regulating plate 7*b*, the rib 7Cb is engaged to the cam groove 6Mb by the movement member 24 moving in the vertical direction along the guide rail 17L, and the rotation posture around a rotation shaft 7Sb is regulated.

Figure 16A:
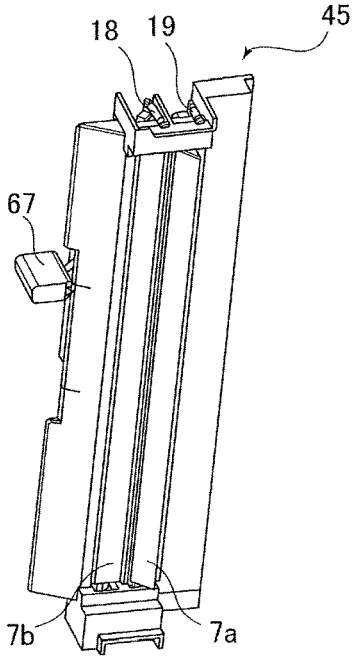
FIG. 16A is a perspective view of a rear end regulating plate for letter size sheets positioned at a regulating position.
Figure 16B:
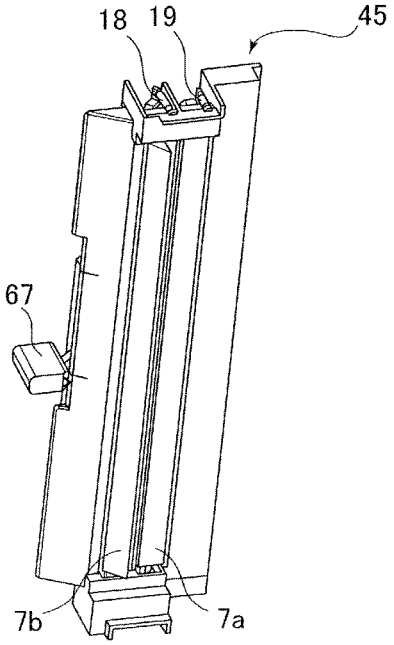
FIG. 16B is a perspective view of a rear end regulating plate for A4 size sheets positioned at a regulating position.

Actually, when the click pin 22 of the movement member 24 is at a position fitting to the upper click groove 17Ma (set as the letter size position), as illustrated in FIG. 16A, the rear end regulating plate 7*a* is positioned at the regulating position, i.e., first regulating position, by the tension springs 19 and 21. At this time, the rear end regulating plate 7*b* pivots against the biasing force of the tension springs 18 and 20, and is positioned at a non-interference position. When the click pin 22 of the movement member 24 is at a position fitting to the lower click groove 17Mb (set as the A4 size position), as illustrated in FIG. 16B, the rear end regulating plate 7*b* is positioned at the regulating position, i.e., second regulating position, by the tension springs 18 and 20. At this time, the rear end regulating plate 7*a* pivots against the biasing force of the tension springs 19 and 21, and is positioned at the non-interference position. That is, the movement member 24 selectively positions the rear end regulating plates 7*a* and 7*b* at the non-interference position where the plate does not interfere with the sheets.

Next, the positions of the rear end regulating plates 7*a* and 7*b* when a letter size sheet (hereinafter referred to as LTR sheet), and an A4 size sheet (hereinafter referred to as A4 sheet) having a sheet size that differs from the LTR sheet, are supported on the sheet supporting base 51 will be described. In FIG. 17, it is assumed that the front end of the sheet bundle S is abutted against the front end regulating plate 16.

Figure 17A:
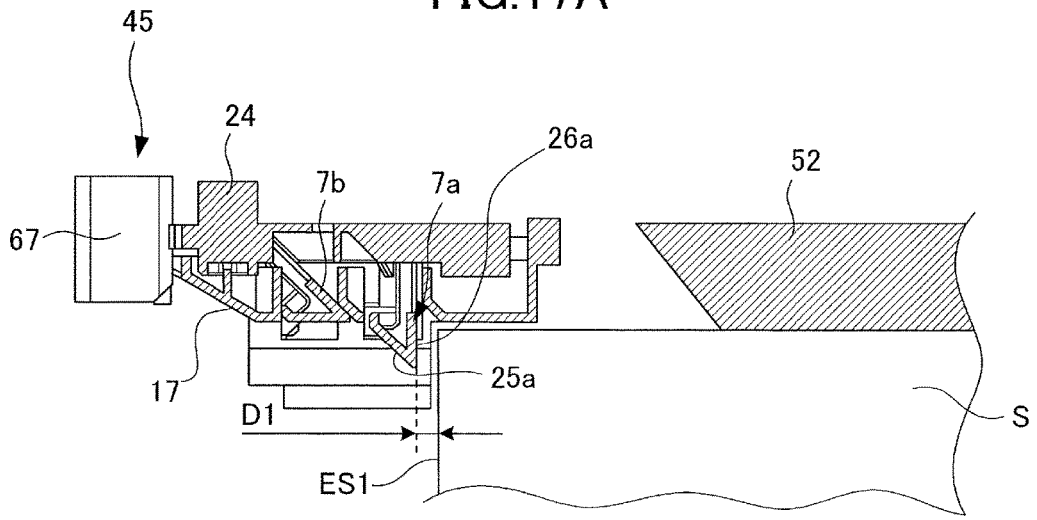
FIG. 17A is a cross-sectional plan view of a state where the rear end regulating plate for letter size sheets is regulating a rear end of a sheet bundle.

At first, when the LTR sheet, i.e., first size sheet, is supported on the sheet supporting base 51, the movement member 24 is positioned at the letter size position illustrated in FIG. 16A. The movement member 24 is moved by having the user hold the operating lever 67 and manually operate the lever to the first position. By positioning the movement member 24 at the letter size position, as illustrated in FIG. 17A, the rear end regulating plate 7*a* will be positioned at the regulating position, and the rear end regulating plate 7*b* will be positioned at the non-interference position. At this time, the rear end regulating plate 7*a* is overlapped with the LTR sheet in the width direction, and a regulation surface 26*a* of the rear end regulating plate 7*a* and a rear end ES1 of the LTR sheet are opposed to one another with a distance D1 formed therebetween. The distance D1 has a distance enough not to be cause sheet jamming when sheets are fed, but enough to regulate the rear end position of the LTR sheets supported on the sheet supporting base 51. On the other hand, the rear end regulating plate 7*b* is stored in the rear end regulating holder 17, and arranged on the outer side in the width direction than the side regulating plate 52 at a non-interference position not interfering with the LTR sheet.

Figure 17B:
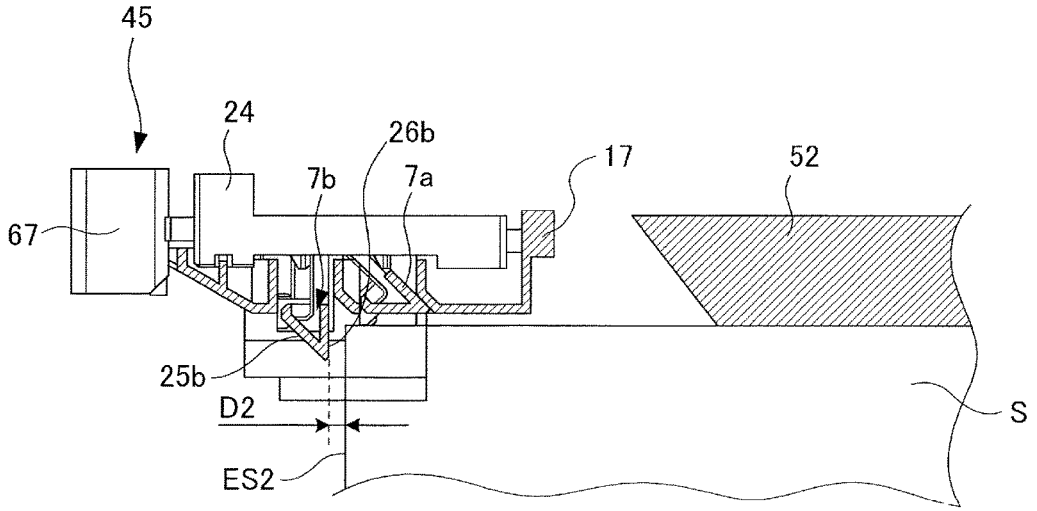
FIG. 17B is a cross-sectional plan view of a state where the rear end regulating plate for A4 size sheets is regulating a rear end of a sheet bundle.

When an A4 sheet, i.e., second size sheet, is supported on the sheet supporting base 51, the movement member 24 is positioned at the A4 size position illustrated in FIG. 16B. The movement member 24 is moved by having the user hold the operating lever 67 and manually operate the lever to the second position. By positioning the movement member 24 at the A4 size position, as illustrated in FIG. 17B, the rear end regulating plate 7*b* will be positioned at the regulating position, and the rear end regulating plate 7*a* will be positioned at the non-interference position. At this time, the rear end regulating plate 7*b* is overlapped with the A4 sheet in the width direction, and a regulation surface 26*b* of the rear end regulating plate 7*b* and a rear end ES2 of the A4 sheet are opposed to one another at a distance D2. The distance D2 has a distance enough no to be cause sheet jamming when sheets are fed, but enough to regulate the rear end position of the A4 sheets supported on the sheet supporting base 51. On the other hand, the rear end regulating plate 7*a* is stored in the rear end regulating holder 17, and arranged on the outer side in the width direction than the side regulating plate 52 at a non-interference position not interfering with the A4 sheet.

Next, the positions of the sheet bundle S and the rear end regulating plates 7*a* and 7*b* when inserting the sheet bundle S to the sheet supporting apparatus 12 will be described. When inserting the sheet bundle S to the sheet supporting apparatus 12, the movement member 24 should be positioned in advance at a position corresponding to the sheet size.

Figure 18:
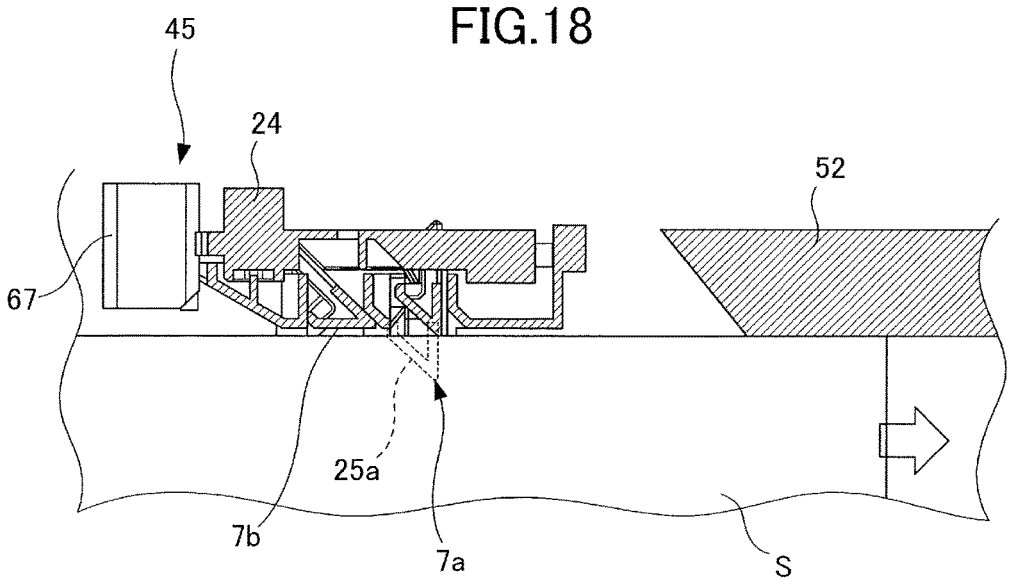
FIG. 18 is a plan view showing a state where the rear end regulating plate for letter size sheets is pressed by the sheet bundle and evacuated.

When the sheet bundle S of LTR sheets is inserted to the sheet supporting apparatus 12, the sheet bundle S is abutted against an inclined plane 25*a*, i.e., first inclined plane, of the rear end regulating plate 7*a*, as illustrated in FIG. 18. The inclined plane 25*a* is inclined so as to approximate the center of the sheet in the width direction, that is, the biasing direction of the tension springs 19 and 21, toward a downstream side in a direction of insertion of the sheet bundle S. When the inclined plane 25*a* is pressed by the sheet bundle S, the rear end regulating plate 7*a* is moved in sliding motion (evacuated) in a sheet width direction, i.e., second direction, intersecting the insertion direction while being guided by a guide groove 17Ga against the biasing force of the tension springs 18 and 20. The rear end regulating plate 7*b* is already positioned at the non-interference position not in contact with the sheet bundle S. Therefore, only the contact pressure against the rear end regulating plate 7*a* will be applied when the user inserts the sheets, so that only a small operating force is required.

Further, when the user inserts the sheet bundle S further, the rear end regulating plate 7*a* is guided by the guide groove 17Ga and moves in sliding motion (pops up) to the regulating position, by the biasing force of the tension springs 19 and 21. Thereby, the user can feel that no more biasing force is applied by the tension springs 19 and 21, and can visually confirm the insertion depth of the sheets.

Similarly, when the sheet bundle S of A4 sheets is inserted to the sheet supporting apparatus 12, the sheet bundle S is abutted against an inclined plane 25*b*, i.e., second inclined plane, of the rear end regulating plate 7*b*. The inclined plane 25*b* is inclined so as to approximate the center of the sheet in the width direction, that is, toward the biasing direction of the tension springs 19 and 21, toward a downstream side in the direction of insertion of the sheet bundle S. When the inclined plane 25*b* is pressed by the sheet bundle S, the rear end regulating plate 7*b* is moved in sliding motion (evacuated) in a sheet width direction, i.e., second direction, intersecting the insertion direction while being guided by a guide groove 17Ga, against the biasing force of the tension springs 18 and 20. A same usability as when the LTR sheet bundle is inserted can be provided when inserting the A4 sheet bundle.

As described, according to the present embodiment, the rear end regulating plates 7*a* and 7*b* are evacuated when the sheets are inserted to the sheet supporting apparatus 12, so that the rear end regulating plates 7*a* and 7*b* will not interfere with the insertion of the sheets, and the usability can be improved. Moreover, when evacuating the rear end regulating plates 7*a* and 7*b*, the rear end regulating plates 7*a* and 7*b* can be evacuated by only a small force since only the contact pressure with either one of the rear end regulating plates 7*a* or 7*b* will be loaded, and the usability can be improved.

Since inclined planes 25*a* and 25*b* are formed on the rear end regulating plates 7*a* and 7*b*, the rear end regulating plates 7*a* and 7*b* can be moved smoothly in the width direction from the regulating position against the biasing force of the tension springs 18 through 21 when the rear end regulating plates 7*a* and 7*b* are pressed from the inserting direction of the sheets. Thereby, the rear end regulating plates 7*a* and 7*b* can be evacuated with even smaller force, and the usability can be improved.

Further, since the rear end regulating plates 7*a* and 7*b* pop up when the front end of the sheets has approximately reached a front end regulating plate 30, the user can realize that the sheets have reached the depth when the contact pressure applied to the sheets is gone. The rear end regulating plates 7*a* and 7*b* are arranged on a side of the sheet supporting apparatus 12 close to the door 2A, so that the user can easily see the plates, and can visually confirm that the sheets have been inserted to the depth by checking that the rear end regulating plates 7*a* and 7*b* have popped up. Further, two sheet sizes, A4 size and letter size, can be inserted to the sheet supporting apparatus 12, and the usability can be improved.

Even further, since the rear end regulating plates 7*a* and 7*b* and the sheet regulation unit 45 are formed in a compact manner within the sheet supporting apparatus 12, they not only improve usability but also prevent the sheet supporting apparatus 12 from being increased in size.

Third Embodiment

Next, a third embodiment of the present invention will be described. The third embodiment adopts a configuration of detecting the position of the rear end regulating plate in addition to the configuration of the second embodiment, and the components equivalent to the second embodiment will either not be illustrated, or the same reference numbers are assigned in the drawings.

The sheet supporting apparatus 12B has a detection unit 40, as illustrated in FIG. 19. The detection unit 40 includes a side detection switch 34, i.e., position detection portion, attached to an apparatus frame not shown, and size detection claws 31 and 32 supported rotatably on a rotation shaft 33 fixed to the apparatus frame not shown. When a movement member 27 is moved, the movement member 27 presses the tips of the size detection claws 31 and 32, and the claws are pivoted. The size detection switch 34 has a first switch 34*a* in contact with the size detection claw 31, i.e., first interlock member, and a second switch 34*b* in contact with the size detection claw 32, i.e., second interlock member. The first switch 34*a* and the second switch 34*b* are independent switches, and when each switch is pressed down to a predetermined position by the size detection claws 31 or 32, internal current is conducted and the state of detection is set to on.

Figure 19A:
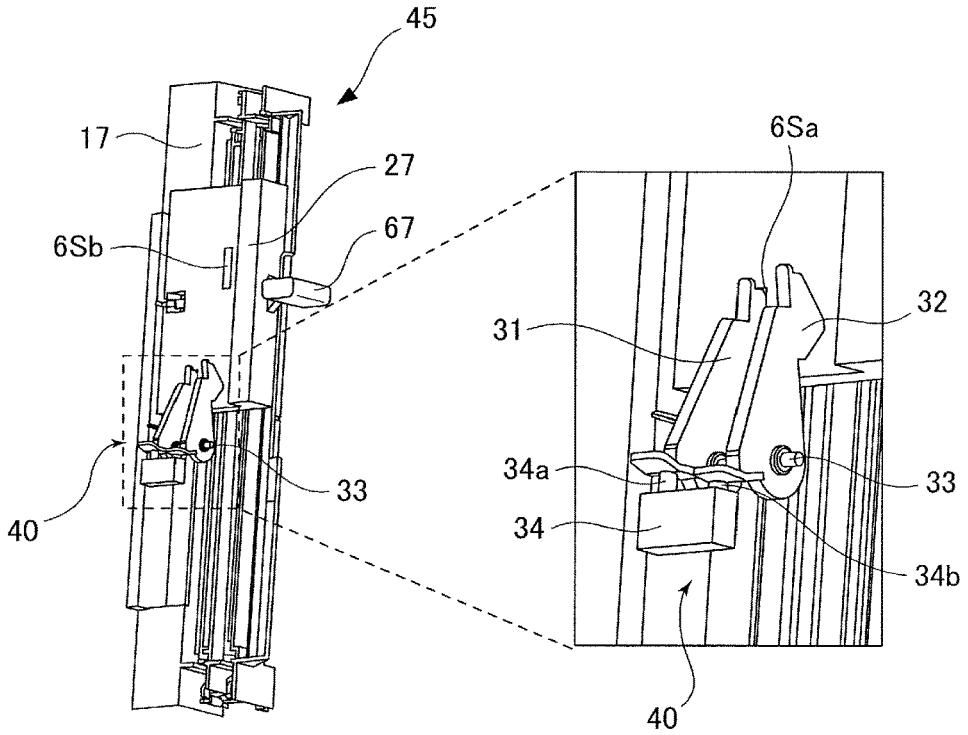
FIG. 19A is a perspective view of a sheet regulation unit according to a third embodiment, showing a state where a movement member is positioned at a letter size position.
Figure 19B:
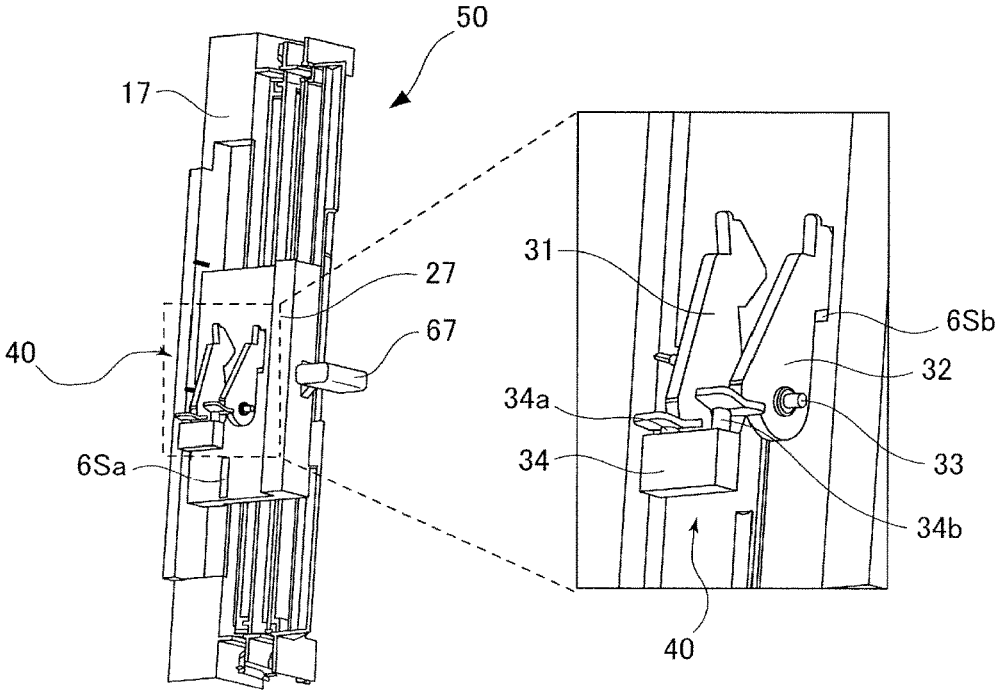
FIG. 19B is a perspective view of the sheet regulation unit according to the third embodiment, showing a state where the movement member is positioned at an A4 size position.

The movement member 27 has two holes 6Sa and 6Sb into which the tips of the size detection claws 31 and 32 can be respectively loosely fit. When the movement member 27 is positioned at the letter size position as shown in FIG. 19A, the size detection claw 31 falls into the hole 6Sa, so that the first switch 34*a* is set to off and the second switch 34*b* is set to on (refer to FIG. 22 (1)). Similarly, when the movement member 27 is positioned at the A4 size position as shown in FIG. 19B, the size detection claw 32 falls into the hole 6Sb, so that the first switch 34*a* is set to on and the second switch 34*b* is set to off (refer to FIG. 22 (2)).

Figure 20A:
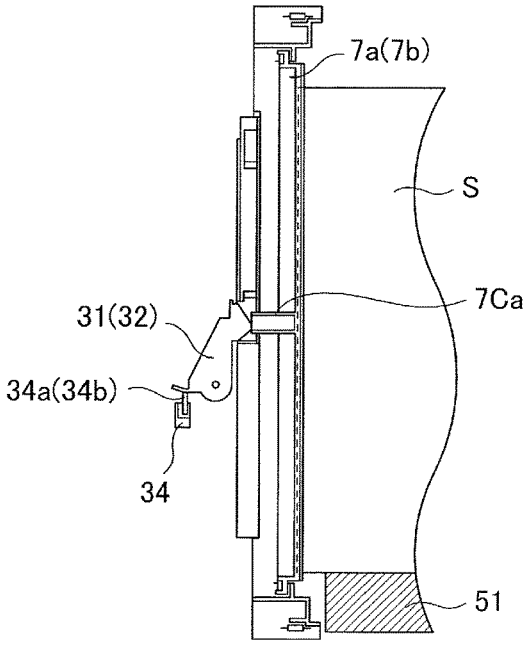
FIG. 20A is a cross-sectional front view of a state where a rear end regulating plate is not pressing a size detection claw.
Figure 20B:
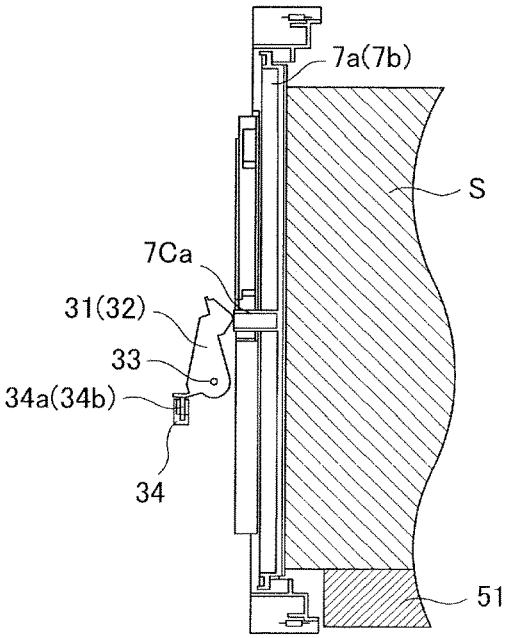
FIG. 20B is a cross-sectional front view of a state where the rear end regulating plate is pressing the size detection claw.

The size detection claws 31 and 32 are disposed at positions respectively opposing to the ribs 7Ca and 7Cb of the rear end regulating plates 7*a* and 7*b*. When the rear end regulating plates 7*a* and 7*b* are evacuated from the regulating position to the sheet width direction, the ribs 7Ca and 7Cb respectively regulate the size detection claws 31 and 32 from falling into the hole 6Sa or 6Sb. For example, as illustrated in FIG. 20A, when the movement member 27 is positioned at the letter size position and the rear end regulating plate 7*a* is evacuated from the regulating position to the sheet width direction, the rib 7Ca regulates the size detection claw 31 from falling into the hole 6Sb, and the first switch 34*a* is turned on. That is, in the state illustrated in FIG. 20B, the first switch 34*a* and the second switch 34*b* are both turned on (refer to FIG. 22 (3)).

When LTR sheets are inserted, the movement member 27 is positioned at the A4 size position, and the relationship between the rear end regulating plate 7*b* and the size detection claw 32 becomes similar to the relationship between the rear end regulating plate 7*a* and the size detection claw 31 described above. Therefore, regardless of whether the size of the sheet bundle S is A4 or letter size, the first switch 34*a* and the second switch 34*b* are both turned on if the sheets are not correctly inserted to the depth (refer to FIG. 22 (3)).

Figure 21:
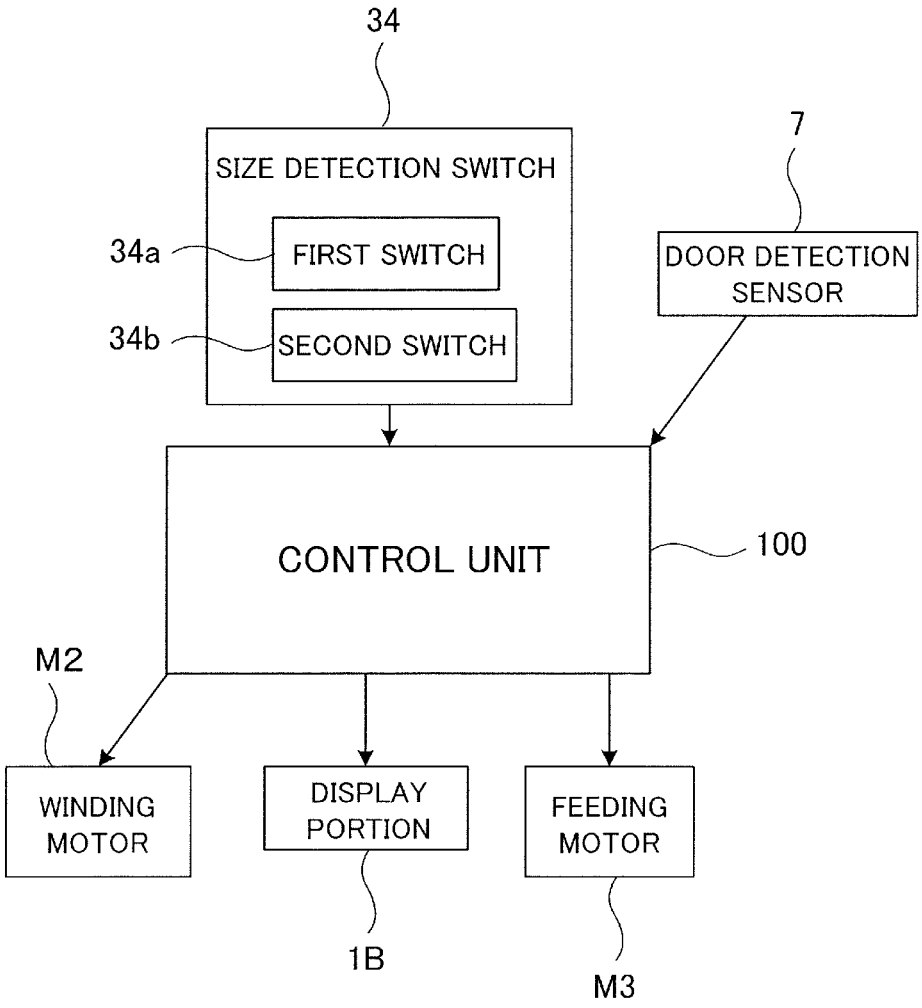
FIG. 21 is a control block diagram according to the third embodiment.

FIG. 21 is a control block diagram of the present embodiment, wherein the sheet supporting apparatus 12 includes a control unit 100, and a RAM and a ROM not shown. The size detection switch 34 having the first switch 34*a* and the second switch 34*b*, and the door detection sensor 7 detecting the opening of the door 2A, are connected to the input side of the control unit 100. A winding motor M2, a display unit 1B, i.e., notification portion, configured of a liquid crystal display and the like, and a feeding motor M3, are connected to an output side of the control unit 100. The control block diagram of the second embodiment corresponds to the control block diagram of FIG. 21 but without the size detection switch 34.

When the size detection switch 34 detects that at least either one of the rear end regulating plates 7*a* or 7*b* has moved from the regulating position, the control unit 100 sets the feeding motor M3 to a stopped state, and restricts the sheet feeding operation. In other words, when the size detection switch 34 detects the state of FIG. 22 (3) indicating a state where the feeding of the sheet cannot be ensured, the control unit 100 restricts the sheet feeding operation. Further, the control unit 100 may also display information on the display unit 1B indicating that the sheets are not correctly set (for example, a display indicating that "the sheets are not correctly set") to notify the user, in addition to restricting the sheet feeding operation. The control unit can sound an alarm to notify the user, or set the winding motor M2 to a stopped state to restrict the elevation of the sheet supporting base 51.

Further, the control unit can further notify the user using the display unit 1B or by sounding an alarm when the door detection sensor 7 detects the open state of the door 2A, or even stop the feeding motor M3 or the winding motor M2 to restrict the sheet feeding operation.

As described, according to the present embodiment, whether a sheet has been set correctly or not can be detected by the detection result of the size detection switch. Therefore, in addition to the effect described in the second embodiment, the present embodiment can notify the user when sheets are not correctly set, to thereby improve the usability of inserting sheets, and prevent jamming of sheets by stopping the sheet feeding operation.

In the second and third embodiments, the sheet inserting direction (direction of arrow Ap illustrated in FIG. 10) and the sheet feeding direction (first direction) are parallel, but the directions are not restricted thereto. For example, the sheet inserting direction and the sheet feeding direction can be intersected. For example, if the sheet inserting direction and the sheet feeding direction are orthogonal, the rear end regulating plates 7*a* and 7*b* mentioned above can restrict the width direction position of the sheet.

The sheet inserting direction and the direction of movement, i.e., direction of evacuation, of the rear end regulating plates 7*a* and 7*b* do not necessarily have to be orthogonal, as long as they are mutually intersected.

In the second and third embodiments, the tension springs 18, 19, 20 and 21 are respectively composed of different springs, but a single spring can be used to bias the respective rear end regulating plates 7*a* and 7*b* to the regulating position.

In the second and third embodiments, the sheet size is not restricted to letter size and A4 size, and can be any arbitrary size. Further, the number of regulating plates, such as the rear end regulating plates, regulating the end portion upstream in the inserting direction of the sheet, is not restricted to two, and can be one, or three or more. Further, it is possible to provide another position of the movement member 27 where both the rear end regulating plates 7*a* and 7*b* are positioned at the non-interference position, so as to enable three types of sheets, which are the letter size, the A4 size and the legal size, to be supported on the sheet supporting base 51.

In the second and third embodiments, the operating lever 67 is manually operated by the user, but the operating lever 67 can also be moved using a power source such as a motor.

The first, second and third embodiments can also be combined as needed. For example, a configuration can be adopted where the operating lever 67 can be moved to the letter size position, the A4 size position and the lock position, as illustrated in the first embodiment, and having rear end regulating plates 7*a* and 7*b*, as illustrated in the second embodiment. In that case, when the operating lever 67 is positioned at the lock position, the rear end regulating plates 7*a* and 7*b* can be locked at the regulating position. According to such arrangement, when the printer is being transported, for example, the operating lever 67 can be positioned at the lock position to thereby restrict movement of the sheet supporting base 51 and also prevent sheets from being inserted to the sheet supporting base 51. Therefore, the user can be prevented from using the printer erroneously and damaging the printer.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-102863, filed May 20, 2015, and Japanese Patent Application No. 2015-081577, filed Apr. 13, 2015, which are hereby incorporated by reference herein in its entirety.

What is claimed is:

1. A sheet supporting apparatus comprising:

a body;

a supporting portion configured to be held by the body and to support a sheet;

a first regulating member regulating a position on an end, in a first direction, of a first size sheet having a first size supported on the supporting portion at a first regulating position;

a second regulating member disposed at a position different from the first regulating member in the first direction, and regulating a position on an end, in the first direction, of a second size sheet having a second size different from the first size supported on the supporting portion at a second regulating position; and a biasing portion biasing the first regulating member to the first regulating position, and biasing the second regulating member to the second regulating position, and a movement portion capable of moving to a first position where the first regulating member is positioned at the first regulating position, and to a second position where the second regulating member is positioned at the second regulating position, wherein the first regulating member is capable of moving from the first regulating position to a second direction intersecting the first direction against a biasing force of the biasing portion, and the second regulating member is capable of moving from the second regulating position to the second direction against the biasing force of the biasing portion, the second regulating member is not overlapped with the first size sheet on the supporting portion in the second direction when viewed in an orthogonal direction orthogonal to the first and second directions in a state where the movement portion is positioned at the first position, and the first regulating member is not overlapped with the second size sheet on the supporting portion in the second direction when viewed in the orthogonal direction in a state where the movement portion is positioned at the second position.

2. The sheet supporting apparatus according to claim 1, wherein the biasing portion comprises a first biasing member biasing the first regulating member to the first regulating position, and a second biasing member biasing the second regulating member to the second regulating position.

3. The sheet supporting apparatus according to claim 1, wherein the first regulating member comprises a first inclined plane moving the first regulating member from the first regulating position to the second direction against a biasing force of the biasing portion in a case where the first regulating member is pressed from the first direction, and the second regulating member comprises a second inclined plane moving the second regulating member from the second regulating position to the second direction against the biasing force of the biasing portion in a case where the second regulating member is pressed from the first direction.

4. The sheet supporting apparatus according to claim 3, wherein the first and second inclined planes are each inclined so as to approximate a center of the sheet, supported on the supporting portion, in the second direction toward a downstream side in the first direction.

5. The sheet supporting apparatus according to claim 1, further comprising a detection unit detecting at least either movement of the first regulating member from the first regulating position or movement of the second regulating member from the second regulating position.

6. The sheet supporting apparatus according to claim 5, wherein the detection unit comprises a first interlock member interlocked with the first regulating member, a second interlock member interlocked with the second regulating member, and a position detection portion detecting a position of the first and second interlock members.

7. The sheet supporting apparatus according to claim 5, further comprising a notification portion notifying information that the sheet is not correctly set to the supporting portion based on a detection result of the detection unit.

8. The sheet supporting apparatus according to claim 5, further comprising a control unit restricting a sheet feeding operation based on a detection result of the detection unit.

9. The sheet supporting apparatus according to claim 1, wherein the body comprises a first wall surface and a second wall surface respectively opposing to both end portions, in the second direction, of the sheet supported on the supporting portion, and the first and second regulating members are disposed on at least either one of the first wall surface or the second wall surface.

10. The sheet supporting apparatus according to claim 1, wherein the first regulating member overlaps in the second direction with the first size sheet supported on the supporting portion in a state where the first regulating member is positioned at the first regulating position, and the second regulating member overlaps in the second direction with the second size sheet supported on the supporting portion in a state where the second regulating member is positioned at the second regulating position.

11. The sheet supporting apparatus according to claim 1, wherein the first direction is an inserting direction in which the sheet is inserted to the body.

12. The sheet supporting apparatus according to claim 1, wherein the first direction is a feeding direction in which the sheet supported on the supporting portion is fed.

13. The sheet supporting apparatus according to claim 12, wherein the second direction is a width direction orthogonal to the feeding direction.

14. An image forming apparatus comprising:

the sheet supporting apparatus according to claim 1; and an image forming unit forming an image on the sheet fed from the sheet supporting apparatus.

15. The sheet supporting apparatus according to claim 1, wherein the movement portion interlocks the first regulating member and the second regulating member.

* * * * *